US010947644B2

(12) United States Patent
Kim et al.

(10) Patent No.: US 10,947,644 B2
(45) Date of Patent: Mar. 16, 2021

(54) C-SHAPED COMPOSITE FIBER, C-SHAPED HOLLOW FIBER THEREOF, FABRIC INCLUDING SAME, AND METHOD FOR MANUFACTURING SAME

(71) Applicant: Toray Advanced Materials Korea Inc., Gyeongsangbuk-do (KR)

(72) Inventors: Dong Won Kim, Daegu (KR); Jin Suk Ma, Daegu (KR); Hyoun Soo Lee, Gyeongsangbuk-do (KR); Mi Nam Choi, Gyeonsangbuk-do (KR); Ho Keun Kim, Gyeonsangbuk-do (KR); Jae Wook Hong, Gyeonggi-do (KR)

(73) Assignee: TORAY ADVANCED MATERIALS KOREA INC., Gyeongsangbuk-Do (KR)

( * ) Notice: Subject to any disclaimer, the term of this patent is extended or adjusted under 35 U.S.C. 154(b) by 934 days.

(21) Appl. No.: 14/906,508

(22) PCT Filed: Aug. 1, 2014

(86) PCT No.: PCT/KR2014/007133
§ 371 (c)(1),
(2) Date: Jan. 20, 2016

(87) PCT Pub. No.: WO2015/016675
PCT Pub. Date: Feb. 5, 2015

(65) Prior Publication Data

US 2016/0251777 A1 Sep. 1, 2016

(30) Foreign Application Priority Data

Aug. 2, 2013 (KR) ..... 10-2013-0092196
Nov. 8, 2013 (KR) ..... 10-2013-0135565
(Continued)

(51) Int. Cl.
*D01F 6/60* (2006.01)
*D01F 6/62* (2006.01)
(Continued)

(52) U.S. Cl.
CPC ..... *D01F 6/62* (2013.01); *D01D 5/24* (2013.01); *D01D 5/253* (2013.01); *D01D 5/34* (2013.01);
(Continued)

(58) Field of Classification Search
CPC . D01D 5/24; D01D 5/253; D01D 5/34; D01F 11/08; D01F 6/60; D01F 6/62;
(Continued)

(56) References Cited

U.S. PATENT DOCUMENTS

2003/0209002 A1* 11/2003 Lancaster ..... D01D 5/253 57/200
2011/0051040 A1 3/2011 Johnson et al.
2012/0128975 A1* 5/2012 Ueda ..... C08G 69/40 428/370

FOREIGN PATENT DOCUMENTS

JP 02019509 A * 1/1990
JP 06-240834 A 8/1994
(Continued)

OTHER PUBLICATIONS

Wikipedia article on "Diameter", Obtained on Sep. 29, 2018.*
(Continued)

*Primary Examiner* — Holly Rickman
*Assistant Examiner* — Lisa Chau
(74) *Attorney, Agent, or Firm* — Masuvalley & Partners

(57) ABSTRACT

Provided are a C-shaped composite fiber, a C-shaped hollow fiber using the same, a fabric including the C-shaped composite fiber and/or the C-shaped hollow fiber, and a manufacturing method of the C-shaped composite fiber, the
(Continued)

C-shaped hollow fiber, and/or the fabric, and more particularly, to a C-shaped composite fiber which has excellent strength and elongation together with improved hollowness, so that there is little deformation of the composite fiber and/or the hollow fiber in the manufacturing process thereof, quality degradation of the hollow fiber is minimized in the elution process thereof, a weight reduction process in a fabric state is not required when manufacturing the fabric, and the manufactured fabric has excellent warmth and lightness, a C-shaped hollow fiber using the same, a fabric including the C-shaped composite fiber and/or the C-shaped hollow fiber, and a manufacturing method of the C-shaped composite fiber, the C-shaped hollow fiber, and/or the fabric.

5 Claims, 3 Drawing Sheets

(30) Foreign Application Priority Data

Nov. 28, 2013 (KR) ..... 10-2013-0146402
Dec. 31, 2013 (KR) ..... 10-2013-0169210

(51) Int. Cl.

| | |
|---|---|
| ***D01F 8/12*** | (2006.01) |
| ***D01F 8/14*** | (2006.01) |
| ***D01D 5/34*** | (2006.01) |
| ***D01D 5/253*** | (2006.01) |
| ***D01D 5/24*** | (2006.01) |
| ***D04B 21/16*** | (2006.01) |
| ***D02G 3/22*** | (2006.01) |
| ***D01F 11/08*** | (2006.01) |
| ***D03D 15/00*** | (2021.01) |
| ***D04B 1/16*** | (2006.01) |

(52) U.S. Cl.
CPC ..... *D01F 6/60* (2013.01); *D01F 8/12* (2013.01); *D01F 8/14* (2013.01); *D01F 11/08* (2013.01); *D02G 3/22* (2013.01); *D03D 15/0027* (2013.01); *D04B 1/16* (2013.01); *D04B 21/16* (2013.01); *D10B 2331/02* (2013.01); *D10B 2331/04* (2013.01)

(58) Field of Classification Search
CPC ..... D01F 8/12; D01F 8/14; D03D 15/0027; D04B 1/16; D04B 21/16; D04B 2331/04
See application file for complete search history.

(56) References Cited

FOREIGN PATENT DOCUMENTS

| | | | | | |
|---|---|---|---|---|---|
| JP | 08-269867 | A | | 10/1996 | |
| JP | 09-279476 | A | | 10/1997 | |
| JP | 09-279477 | A | | 10/1997 | |
| JP | 2009-150022 | A | | 7/2009 | |
| JP | 2009150022 | A | * | 7/2009 | |
| KR | 1019960011604 | B1 | | 8/1996 | |
| KR | 100123041 | B1 | | 9/1997 | |
| KR | 100408957 | B1 | | 11/2003 | |
| KR | 10-0861023 | B1 | | 9/2008 | |
| WO | WO-2007052570 | A1 | * | 5/2007 | ..... A41G 3/0083 |

OTHER PUBLICATIONS

WIPO, Korean International Search Authority, International Search Report dated Nov. 25, 2014 in International Patent Application No. PCT/KR2014/007133, Korean language original and English translation, 5 pages.

* cited by examiner

[Fig. 1a]
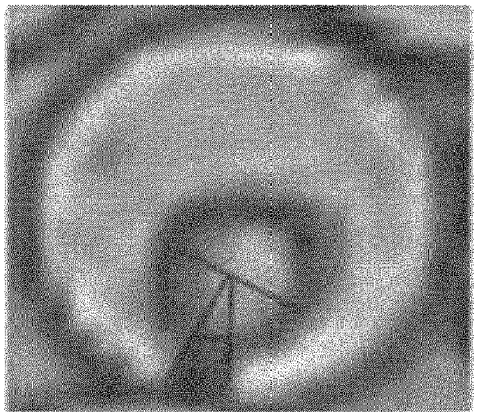
[Fig. 1b]
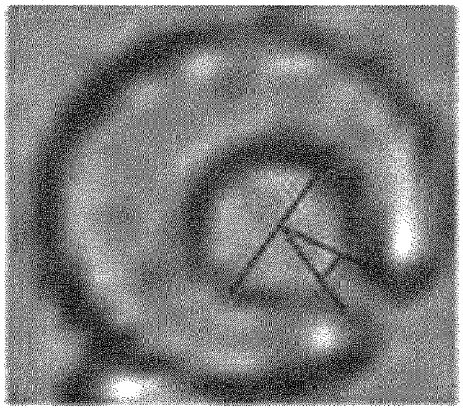
[Fig. 1c]
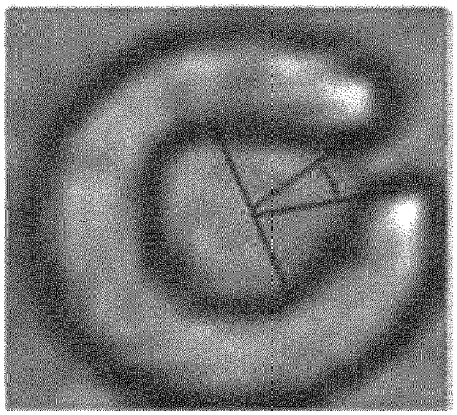
[Fig. 1d]
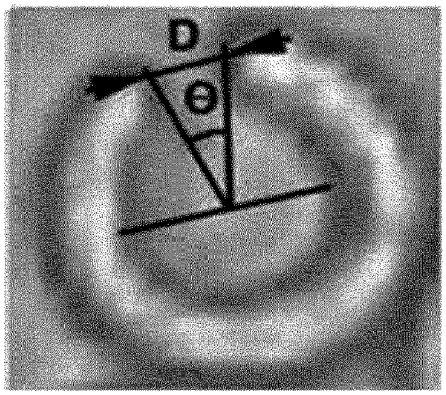

[Fig. 2]
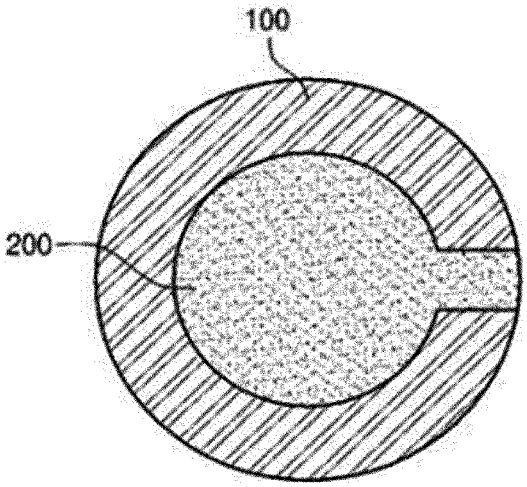
[Fig. 3]
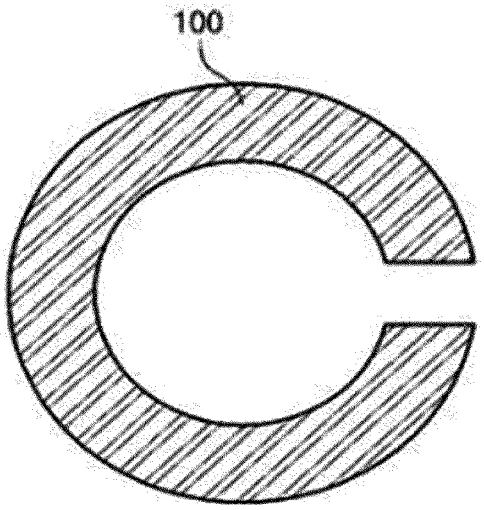
[Fig. 4]
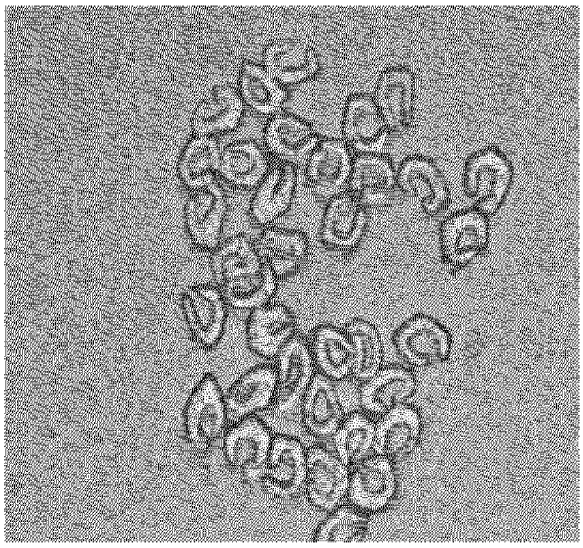

[Fig. 5]
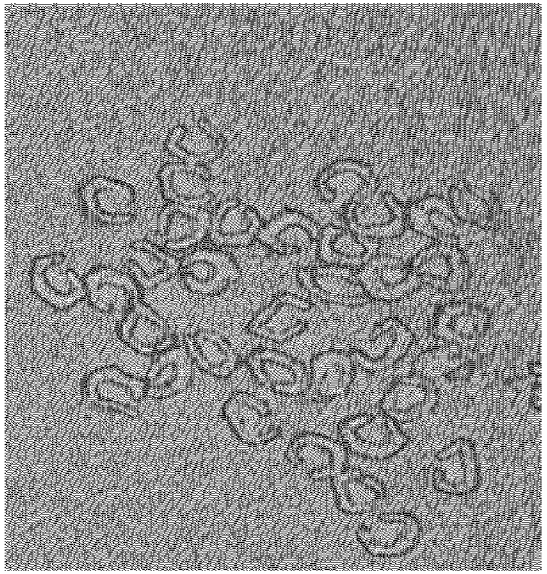
[Fig. 6]
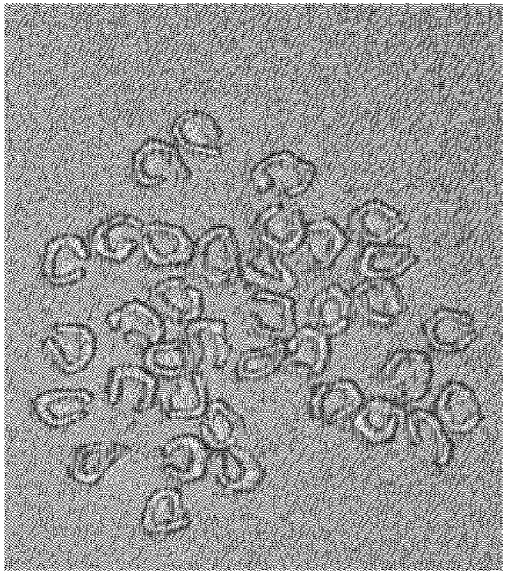
[Fig. 7]
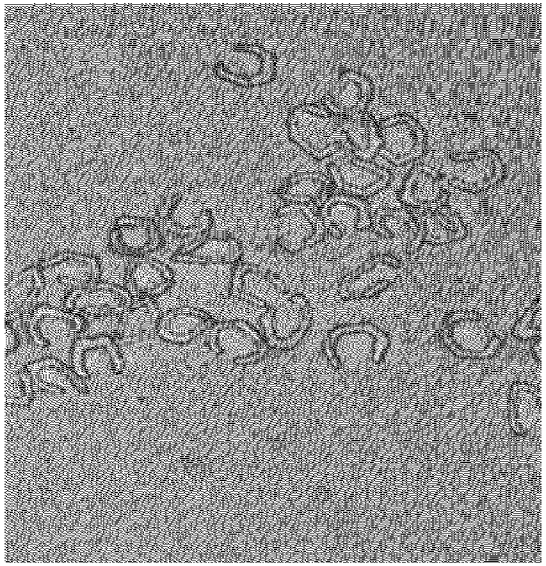

C-SHAPED COMPOSITE FIBER, C-SHAPED HOLLOW FIBER THEREOF, FABRIC INCLUDING SAME, AND METHOD FOR MANUFACTURING SAME

RELATED APPLICATIONS

This application is the U.S. National Phase of and claims priority to International Patent Application No. PCT/KR/2014/007133, International Filing Date Aug. 1, 2014, entitled C-Shaped Composite Fiber, C-Shaped Hollow Fiber Thereof, Fabric Including Same, And Method For Manufacturing Same; which claims benefit of Korean Patent Application No. KR10-2013-0092196 filed Aug. 2, 2013; Korean Patent Application No. KR10-2013-0135565 filed Nov. 8, 2013; Korean Patent Application No. KR10-2013-0146402 filed Nov. 28, 2013 ; and Korean Patent Application No. KR10-2013-0169210 filed Dec. 31, 2013; all of which are incorporated herein by reference in their entireties.

BACKGROUND OF THE INVENTION

The present invention disclosed herein relates to a C-shaped composite fiber, a C-shaped hollow fiber using the same, a fabric including the C-shaped composite fiber and/or the C-shaped hollow fiber, and a manufacturing method of the C-shaped composite fiber, the C-shaped hollow fiber, and/or the fabric, and more particularly, to a C-shaped composite fiber which has excellent strength and elongation together with improved hollowness, so that there is little deformation of a composite fiber and/or a hollow fiber in the manufacturing process thereof, quality degradation of the hollow fiber is minimized in the elution process thereof, a weight reduction process in a fabric state is not required when manufacturing the fabric, and the manufactured fabric has excellent warmth and lightness, a C-shaped hollow fiber using the same, a fabric including the C-shaped composite fiber and/or the C-shaped hollow fiber, and a manufacturing method of the C-shaped composite fiber, the C-shaped hollow fiber, and/or the fabric.

Synthetic fibers such as polyester and polyamide are being widely used for industry as well as clothing due to excellent physical and chemical properties thereof, and have industrially significant values. However, these synthetic fibers have drawbacks in that the single yarn fineness thereof has a single distribution and they are significantly different in warmth from natural fibers such as hemp and cotton, and development of hollow synthetic fibers is thus being widely carried out in order to remedy these drawbacks Hollow yarn technologies are old enough that a basic patent application was already filed in 1956, and hollow yarn has an advantage in term of lightness due to lower density caused by weight reduction of hollow portions. Furthermore, warmth may be also maintained using the low thermal conductivity of air present in the hollow portion. Giving warmth to clothing as fibrous assembly was to obtain materials which are not only lightweight and thin, but also have excellent warmth. While winter clothing becomes heavy as the thickness thereof increases, reducing the weight thereof lowers warmth, so that hollow yarn is being widely used to remedy such shortcomings.

Generally, hollow yarn fibers having high hollowness contain a large amount of air space, and thus have low density and excellent warmth. Therefore, the hollow yarn fibers have excellent properties such as lightness and warmth, and are widely used for climbing wear, sportswear, functional clothing, blankets, insulating blankets, sleeping bags, and the like.

In general methods of manufacturing hollow yarn, there has been widely used a method of forming the hollow by including ambient air into the central portion in such a way that a polymer is extruded from unconnected slits and then fused before it is completely solidified.

Meanwhile, when hollow yarn manufactured by the method in which a polymer is extruded and then fused before it is completely solidified, is subjected to a post-treatment process such as a false twist texturing in the case of 30% or more of hollowness, the cross section thereof may be easily collapsed, that is concrescence (extinction of the hollow) may be occurred, so that it is mostly used in a filament state or used through spinning after cutting into staples (single fibers).

However, when they are used in a filament state, rebound elastic force through the hollow increases. Therefore, it is difficult to develop for clothing due to smooth tactility and reduced drapability for using as general circular knitted fabrics or textiles for clothing, so that they are partially used only for limited applications. Furthermore, raising fabrics disadvantageously have poor raising properties due to lower bulkiness, smooth surface of hollow yarn, and excellent rebound elastic force. Moreover, in the case of a composite with other fibers, there were limitations in that lightness and warmth as characteristics of hollowness were degraded by half, the thickness of fabrics increased due to a composite of grey yarn, and improvement of tactility was insignificant.

Alternatively, there is a method of spinning single fibrous staple. In the case of spinning, it is possible to develop for various applications due to excellent tactility, increased strength, and easy composite forming with other fibers. However, there are limitations in that manufacturing costs for staple (single fiber) are high and pilling properties are poor. Moreover, a secondary process, i.e., spinning, should be further required, so that separate spinning equipment should be provided, and time and cost burden caused by the additional process may also occur.

In the case of filaments for general clothing, tactility may be improved through a post-treatment process such as texturing, i.e., the false twist texturing in order to compensate the aforementioned limitations. However, this false twist texturing imparts twist through a lot of tension at a high temperature, and thus disadvantageously causes distorted hollow in hollow yarn. Particularly, when hollow yarn has hollowness of 30% or more, there was a limitation in that concrescence occurred relatively more easily because the outside wall of fiber surrounding the hollow is thin. On the other hand, when hollow yarn has hollowness less than 30%, hollow filaments subjected to a post-treatment process such as the false twist texturing also have low hollowness, so that hollowness drops to 5% or less after the false twist texturing and it is thus difficult to find hollow.

A method of using elution-type hollow yarn has been tried in order to solve these limitations. The elution-type hollow yarn is subjected to an elution process before a dyeing process after a post-treatment such as the false twist texturing, and may thus be present without the collapse of the hollow.

Although, the hollow may exist, the strength of composite fibers before elution is lower than that of hollow yarn spun alone, and when the elution is completed, the strength is much lowered leaving only sheath parts. Therefore, there is also a limitation in that the tearing strength of the woven fabric is very low. Furthermore, typical C-shaped hollow fibers including one open slit, have limitations in that the hollow is easily deformed and destroyed by external force compared with hollow fibers without a slit, and when the hollow is biased toward the slit opened in one side of the hollow fiber, the collapse of the hollow may even more easily occur.

Typical hollow fibers also have hollowness less than 30%, and fabrics including these hollow fibers have thus limitations in that it is difficult to expect effects such as warmth and lightness.

Furthermore, although there have been attempts to manufacture fabrics including hollow fibers having improved hollowness in order to maximize warmth and lightness of the fabrics, it was even difficult to manufacture hollow fibers themselves having hollowness of 30% or more as grey yarn. Moreover, even if hollow fibers having improved hollowness are manufactured, mechanical properties, such as strength of hollow fibers, are significantly degraded. When only hollowness is increased, the elution time becomes longer in the elution process using an alkaline solution, and the elution is not properly performed, thereby frequently resulting in drawbacks such as dyeing defects and hollow reduction caused by non-uniform elution. These limitations are directly connected to quality degradation and failure of fabrics, and warmth and lightness may not be entirely realized.

Furthermore, the lengthened elution processing time causes alkaline attack on fiber-forming components of the C-shaped hollow fibers, thereby resulting in quality degradation and failure of the C-shaped hollow fibers and fabrics including the same.

Korean Patent Application No. 2007-0051838 relates to polyester hollow yarn having excellent tearing strength and wear resistance and a manufacturing method thereof, and discloses a hollow fiber manufactured using a spinneret including two or more slits arranged apart from each other. In the prior art of the above patent application, it is disclosed that, in C-shaped having one slit, hollowness is not high due to a small amount of air inflow to space between the slits, and physical properties such as strength are degraded due to a thin outer wall of grey yarn even with increased hollowness. Furthermore, in the case of the above patent application, the hollow is formed by solidification of polyester after spinning instead of using a manufacturing method of elution-type hollow fibers through composite spinning, so that there is a limit in manufacturing hollow fibers having high hollowness. Even if hollow fibers having high hollowness are manufactured, they do not have enough strength to withstand the manufacturing process, so that there are limitations in that spinning operability is deteriorated or the hollow of hollow fibers is deformed or destroyed during a post-treatment process and/or a weaving process. Furthermore, in the above patent application, hollow fibers are manufactured through the spinneret having a plurality of slits, so that there is a limitation in that the strength of manufactured hollow fibers is lower.

SUMMARY OF THE INVENTION

The first object of the present invention is to provide a polyester-based C-shaped composite fiber which, when specific conditions of the present invention are satisfied, has excellent core sectional area ratio compared with typical composite fibers, and thus maximizes effects such as warmth and lightness of a hollow fiber which will be subsequently manufactured using the same, does not cause deformation and destruction of the composite fiber with excellent strength in the manufacturing process, and has improved flexibility with excellent elongation. The object of the present invention is also to provide a C-shaped composite fiber which even if the core sectional area ratio increases in the elution process for manufacturing a hollow fiber subsequently, the elution rate also increases, so that the time required for the elution process may be uniform.

The second object of the present invention is to provide a C-shaped composite fiber and a manufacturing method thereof, wherein a C-shaped hollow fiber satisfying specific conditions of the present invention does not cause defects such as dyeing defects due to uniform elution, and minimizes deformation and destruction of the hollow due to improved strength compared with typical hollow fibers, thereby being capable of entirely achieving original functions as a hollow fiber, such as warmth and lightness, and maximizing functions of the hollow fiber with excellent hollowness.

The third object of the present invention is to provide a fabric and a manufacturing method thereof, wherein the C-shaped composite fiber and/or hollow fiber satisfying specific conditions of the present invention have excellent physical properties as described above, and the fabric includes the fiber having such excellent physical properties as grey yarn and has thus maximized warmth and lightness. The object of the present invention is also to provide a fabric having excellent quality and a manufacturing method thereof, wherein the hollow portion of the C-shaped composite fiber and/or hollow fiber included in the fabric is entirely eluted and dyeing defects do not occur.

In order to achieve the aforementioned first object, the present invention provides a C-shaped composite fiber including a core part and a sheath part surrounding the core part, wherein the sheath part has a C-shaped cross section to expose the core part to the outside at one side thereof, and the C-shaped composite fiber satisfies all of the conditions (1) to (4) below.

$$30 \leq \text{core sectional area ratio } (\%) \leq 65 \quad (1)$$

$$20^\circ \leq \text{slit angle } (\theta) \leq 30^\circ \quad (2)$$

$$0.13 < \frac{\text{core sectional area ratio } (\%)}{100 \times \text{slit spacing } (d)} < 0.33 \quad (3)$$

$$1 \leq \text{Eccentric distance } (s) \times \frac{R_2}{R_1} < 2.4 \quad (4)$$

where, the slit angle (θ) is an angle between two straight lines each connecting the center of the core part and two discontinuous points of the sheath part, the slit spacing (d) is a distance (μm) between two discontinuous points of the sheath part, the eccentric distance (s) is a distance (μm) between the center of the entire cross section of the C-shaped composite fiber and the center of the core part, $R_1$ is a diameter (μm) of the entire cross section of the C-shaped composite fiber, and $R_2$ is a diameter (μm) of the cross section of the core part of the C-shaped composite fiber.

According to an exemplary embodiment of the present invention, the sheath part may include at least any one fiber-forming component of polyester or polyamide, and the core part may include a polyester-based eluting component including a copolymer which is prepared by polycondensation of polyalkylene glycol and an esterification reactant including an acid component including a terephthalic acid (TPA), a diol component including ethylene glycol (EG), and a dimethyl sulfoisophthalate sodium salt (DMSIP).

According to another exemplary embodiment of the present invention, the polyester-based eluting component of the core part may be prepared by the steps including 1-1) preparing an esterification reactant which includes an acid component including a terephthalic acid and a diol component including ethylene glycol in a molar ratio of about 1:1.1 to about 1:2.0, and includes about 0.1 to about 3.0 mol % of a dimethyl sulfoisophthalate sodium salt based on the total moles of the acid component including the terephthalic acid and the dimethyl sulfoisophthalate sodium salt, and 1-2) preparing a copolymer through polycondensation after mixing about 7 to about 14 parts by weight of polyalkylene glycol with respect to 100 parts by weight of the esterification reactant.

According to still another exemplary embodiment of the present invention, the C-shaped composite fiber may further satisfy the condition (5) below.

$$2.5 < \frac{\sqrt[4]{\text{EXP(eccentric distance } (s) \times \text{slit spacing } (d)}}{\cos\left(\frac{\text{slit angle } (\theta)}{2}\right)} < 7.5 \quad (5)$$

Furthermore, in order to achieve the aforementioned second object, the present invention provides a C-shaped hollow fiber having a C-shaped cross section including an open slit, wherein the C-shaped hollow fiber satisfies all of the conditions (1) to (4) below.

$$30 \leq \text{hollowness } (\%) \leq 65 \quad (1)$$

$$20° \leq \text{slit angle } (\theta) \leq 30° \quad (2)$$

$$0.13 < \frac{\text{hollowness } (\%)}{100 \times \text{slit spacing } (d)} < 0.33 \quad (3)$$

$$1 \leq \text{Eccentric distance } (s) \times \frac{R_2}{R_1} < 2.4 \quad (4)$$

where, the slit angle (θ) is an angle between two straight lines each connecting the center of a hollow and two discontinuous points of a sheath part, the slit spacing (d) is a distance (μm) between two discontinuous points of the sheath part, the eccentric distance (s) is a distance (μm) between the center of the cross section of the C-shaped hollow fiber and the center of the cross section of the hollow, $R_1$ is a diameter (μm) of the entire cross section of the C-shaped hollow fiber, and $R_2$ is a diameter (μm) of the cross section of the hollow of the C-shaped hollow fiber.

According to an exemplary embodiment of the present invention, the C-shaped hollow fiber may further satisfy the condition (5) below.

$$2.5 < \frac{\sqrt[4]{\text{EXP(eccentric distance } (s) \times \text{slit spacing } (d)}}{\cos\left(\frac{\text{slit angle } (\theta)}{2}\right)} < 7.5 \quad (5)$$

According to another exemplary embodiment of the present invention, the C-shaped hollow fiber may be any one selected from the group consisting of partially oriented yarn (POY), spin draw yarn (SDY), draw textured yarn (DTY), air textured yarn (ATY), edge crimped yarn, and interlaced yarn (ITY).

Furthermore, in order to achieve the aforementioned second object, the present invention provides a method of manufacturing a C-shaped hollow fiber, the method including eluting the core part from the C-shaped composite fiber according to the present invention.

According to an exemplary embodiment of the present invention, the eluting of the core part may include the steps of 1-1) plying the C-shaped composite fibers to 1 to 10 plies in a dyeing paper tube to perform soft winding, and 1-2) treating the C-shaped composite fibers wound in the dyeing paper tube with an about 1 to about 5 wt % of a sodium hydroxide solution at about 80 to about 100° C. to elute the core parts.

Meanwhile, in order to achieve the aforementioned third object, the present invention provides a fabric including a C-shaped composite fiber, the fabric including the C-shaped composite fiber according to the present invention.

Furthermore, in order to achieve the aforementioned third object, the present invention provides a method of manufacturing a fabric including a C-shaped composite fiber, the method including the steps of (1) preparing the C-shaped composite fiber according to the present invention, and (2) weaving or knitting including the composite fiber to manufacture the fabric.

Meanwhile, in order to achieve the aforementioned third object, the present invention provides fabric including a C-shaped hollow fiber, the fabric including the C-shaped hollow fiber according to the present invention.

Furthermore, in order to achieve the aforementioned third object, the present invention provides a method of manufacturing a fabric including a C-shaped hollow fiber, the method including the steps of (1) preparing the C-shaped composite fiber according to the present invention, (2) eluting the core part from the composite fiber, and (3) weaving or knitting including the core-eluted hollow fiber to manufacture the fabric.

According to an exemplary embodiment of the present invention, step (3) may be mixed weaving or mixed knitting of the hollow fiber and a different type of grey yarn.

Hereinafter, the terms used herein will be described.

The term "fiber" used herein refers to 'yarn' or 'thread', and includes various types of common yarn and fiber.

The term "eccentric distance" used herein means a distance between the center of the entire cross section of the C-shaped composite fiber and the center of the core part included in the entire cross section of the C-shaped composite fiber, or a distance between the center of the entire cross section of the C-shaped hollow fiber and the center of the hollow included in the entire cross section of the C-shaped hollow fiber.

The term "composite fiber" used herein includes grey yarn itself prepared by composite spinning or a fiber subjected to texturing such as partially orientation, drawing, and false twist texturing, and refers to a fiber prior to the elution of the core part.

Advantageous Effects

The C-shaped composite fiber satisfying specific conditions of the present invention has improved core sectional area ratio compared with typical composite fibers, so that the C-shaped composite fiber maximizes effects such as warmth and lightness of a hollow fiber which will be subsequently manufactured using the same, does not cause deformation and destruction of the composite fiber with excellent strength in the manufacturing process, and has improved flexibility with excellent elongation. Furthermore, even if the core sectional area ratio increases in the elution process for manufacturing the hollow fiber subsequently, the elution rate increases, so that the time required for the elution process may be uniform. Accordingly, the production time may be shortened, so that alkaline attack on the hollow fiber may be prevented, and the core part may be entirely eluted, so that quality degradation caused by drawbacks such as dyeing defects and hollow reduction may be prevented.

Also, the C-shaped hollow fiber satisfying specific conditions of the present invention has excellent hollowness compared with typical hollow fibers, so that the C-shaped hollow fiber maximizes effects of the hollow fiber, such as warmth and lightness. At the same time, the C-shaped composite fiber according to the present invention has improved strength, and thus causes little deformation and destruction of the composite fiber in the manufacturing process such as the post-treatment process, so that it is possible to obtain the hollow fiber in which the hollow is entirely conserved. Furthermore, even if the content of the core part included in the composite fiber increases in the elution process for manufacturing the hollow fiber, the elution rate increases, so that the time required for the elution process may be uniform. Accordingly, the production time may be shortened and the core part may be entirely eluted, so that drawbacks such as dyeing defects, hollow reduction, alkaline attack on the hollow fiber may be minimized and the C-shaped hollow fiber having excellent quality may thus be obtained.

Furthermore, a fabric including grey yarn satisfying specific conditions of the present invention may be woven or knitted in the grey yarn state after a weight reduction process because the C-shaped hollow fiber included therein allows for the fabric to have excellent strength. In spite of mixed weaving or mixed knitting with a different type of grey yarn, it is possible to manufacture a fabric without a damage of the different type of grey yarn, which may be caused by the weight reduction process using an alkaline solution. Since there is no destruction of the hollow in the manufacturing process of the fabric, it is possible to manufacture a fabric which entirely demonstrates warmth and lightness and has improved flexibility with excellent elongation. Moreover, the C-shaped hollow fiber included in the fabric has significantly improved hollowness compared with hollowness of typical hollow fibers, so that effects such as warmth and lightness of the fabric may be maximized. Furthermore, materials in the hollow of the C-shaped hollow fiber included in the fabric are entirely eluted, so that dyeing defects which may be caused by non-uniform elution do not occur and the fabric including the hollow fiber thus has excellent quality.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings:

FIG. 1A is a sectional view of a hollow fiber having hollowness of 30% according to an exemplary embodiment of the present invention;

FIG. 1B is a sectional view of a hollow fiber having hollowness of 40% according to an exemplary embodiment of the present invention;

FIG. 1C is a sectional view of a hollow fiber having hollowness of 50% according to an exemplary embodiment of the present invention;

FIG. 1D is a sectional view of a hollow fiber having hollowness of 60% according to an exemplary embodiment of the present invention;

FIG. 2 is a schematic diagram of a C-shaped composite fiber according to an exemplary embodiment of the present invention;

FIG. 3 is a schematic diagram of a C-shaped hollow fiber according to an exemplary embodiment of the present invention;

FIG. 4 is a sectional view of a C-shaped hollow fiber according to an exemplary embodiment of the present invention, which is treated with false twist texturing and has hollowness of 30%;

FIG. 5 is a sectional view of a C-shaped hollow fiber according to an exemplary embodiment of the present invention, which is treated with false twist texturing and has hollowness of 40%;

FIG. 6 is a sectional view of a C-shaped hollow fiber according to an exemplary embodiment of the present invention, which is treated with false twist texturing and has hollowness of 50%; and FIG. 7 is a sectional view of a C-shaped hollow fiber according to an exemplary embodiment of the present invention, which is treated with false twist texturing and has hollowness of 60%.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, the present invention will be described in more detail.

As described above, typical composite fibers were not able to ensure tear strength of a final fabric produced by the manufacturing process including composite spinning, post-treatment, weaving, and dyeing, and tearing of the fabric thus frequently occurred. Also, typical composite fibers have a core sectional area ratio less than 30%, so that there was a limitation in demonstration of warmth and lightness of a hollow fiber. Furthermore, despite typical efforts to maximize warmth and lightness, it was even difficult to manufacture composite fibers having a core sectional area ratio of 30% or more. When the core sectional area ratio increases, the strength of the composite fiber and/or a hollow fiber manufactured using the same is too lowered to withstand a post treatment process such as false twist texturing of grey yarn and a weaving process for manufacturing a fabric. Apart from the increased core sectional area ratio, the elution rate of the core part could not be improved in the elution process for manufacturing the hollow fiber subsequently, so that the elution time was lengthened. Furthermore, when the core sectional area ratio increases, the strength and elongation of the composite fiber may decrease. However, the width of decrease in the strength and elongation was significant in typical composite fibers, so that there was a limitation in that it was difficult to manufacture composite fibers having excellent warmth, lightness, and flexibility, without any deformation of the core part.

Thus, according to a first embodiment of the present invention, it is provided a C-shaped composite fiber which includes a core part and a sheath part surrounding the core part, wherein the sheath part has a C-shaped cross section to expose the core part to the outside at one side thereof, and the C-shaped composite fiber satisfies all of the conditions (1) to (4) below, seeking the solution of the aforementioned limitations.

Using the C-shaped composite fiber, it is possible to obtain a significantly improved core sectional area ratio compared with typical composite fibers, and it is possible to maximize effects such as warmth and lightness of a hollow fiber manufactured using the C-shaped composite fiber. It is also possible to manufacture a polyester-based C-shaped composite fiber which does not cause deformation and destruction the composite fiber in the manufacturing process, even if the core sectional area ratio of the composite fiber significantly increases, due to excellent strength of the C-shaped composite fiber by composite spinning, and has improved flexibility with excellent elongation. Furthermore, even if the core sectional area ratio increases in the elution process for manufacturing the hollow fiber subsequently, the elution rate increases, so that the time required for the elution process may be uniform. Accordingly, the production time may be shortened, so that alkaline attack on the hollow fiber may be prevented, and the core part may be entirely eluted, so that drawbacks such as dyeing defects and hollow reduction may be prevented.

$$30 \leq \text{core sectional area ratio } (\%) \leq 65 \quad (1)$$

$$20^\circ \leq \text{slit angle } (\theta) \leq 30^\circ \quad (2)$$

$$0.13 < \frac{\text{core sectional area ratio } (\%)}{100 \times \text{slit spacing } (d)} < 0.33 \quad (3)$$

$$1 \leq \text{Eccentric distance } (s) \times \frac{R_2}{R_1} < 2.4 \quad (4)$$

where, the slit angle (θ) is an angle between two straight lines each connecting the center of the core part and two discontinuous points of the sheath part, the slit spacing (d) is a distance (μm) between two discontinuous points of the sheath part, the eccentric distance (s) is a distance (μm) between the center of the entire cross section of the C-shaped composite fiber and the center of the core part, R1 is a diameter (μm) of the entire cross section of the C-shaped composite fiber, and R2 is a diameter (μm) of the cross section of the core part of the C-shaped composite fiber.

First, as the condition (1), the C-shaped composite fiber satisfies 30≤core sectional area ratio (%)≤65.

The core sectional area ratio (%) means the percentage of the sectional area of the core part included in the composite fiber with respect to the entire sectional area of the C-shaped composite fiber. When the core sectional area ratio is less than 30%, warmth and lightness of a hollow fiber which will be subsequently manufactured using the composite fiber are too low to demonstrate functions as the hollow fiber. On the other hand, when the core sectional area ratio is greater than 65%, strength after the elution of the composite fiber decreases due to a thin structure of the sheath part, so that the tearing strength of a fabric woven using the composite fiber is lowered and a final product may thus be easily torn.

Specifically, when the core sectional area ratio (%) is 70% (Table 7, Comparative Example 6), the strength is 3.72 g/de, and it can thus be seen that the strength is lowered by about 11.4% compared with the case where the core sectional area ratio is 60% (Table 4, Example 4). It can also be seen that spinnability is not good.

Next, as the condition (2), the C-shaped composite fiber satisfies 20°≤slit angle (θ)≤30°.

The slit angle (θ) means an angle between two straight lines connecting the center of the core part and two discontinuous points of the sheath part. Specifically, FIG. 1 illustrates sectional views according to hollowness of the C-shaped hollow fiber after the elution of the core part of the C-shaped composite fiber according to an exemplary embodiment of the present invention. As shown in FIGS. 1A to 1D, it can be seen that the slit angle (θ in FIG. 1D) is constant regardless of the core sectional area ratio (%) of the composite fiber, which corresponds to hollowness of the hollow fiber.

In the present invention, the slit angle (θ) is constant regardless of the core sectional area ratio (%) because, in the C-shaped composite fiber according to the present invention, when the core sectional area ratio (%) is small, the center of the core part in the cross section of the composite fiber is biased toward the open slit of the C-shaped composite fiber, but as the core sectional area ratio (%) increases, the center of the core part in the cross section of the composite fiber moves toward the center of the C-shaped composite fiber.

When the slit angle (θ) is less than 20°, the elution time of the core part becomes longer in the manufacturing process of the C-shaped hollow fiber using the C-shaped composite fiber of the present invention, so that the manufacturing process may be lengthened. The lengthened elution process may cause alkaline attack on the sheath part, so that quality of C-shaped hollow fibers to be manufactured may be degraded. Also, when the core sectional area ratio (%) significantly increases, the elution time of the core part may further increases. Furthermore, remaining core parts may exist, which are not eluted in the process of eluting the core part, so that the hollow may be reduced and effects such as lightness and warmth of the hollow fiber may be deteriorated. Still furthermore, it may be difficult to realize desired physical properties of the present invention, for example, dyeing defects may occur due to non-uniform elution, thereby causing concerns for quality degradation.

Specifically, it can be seen that the elution time in the case where the slit angle is 17° (Table 7, Comparative Example 7) is longer than that in the case where the slit angle is 25° (Table 4, Example 3).

When the slit angle (θ) is greater than 30°, circular structures may disappear, and air space may thus not be effectively given to the core part, thereby causing degradation of warmth and strength. Furthermore, when the slit angle varies according to the core sectional area ratio (%), it may be difficult to realize desired physical properties of the present invention, for example, workability in post-treatment processes may be deteriorated due to different elution process conditions.

Specifically, when the slit angle is 37° (Table 7, Comparative Example 8), the strength is 2.21 g/de, which is just about 50% of the strength of an exemplary embodiment of the present invention (Table 4, Example 3), showing a decrease in strength.

Next, as the condition (3), the C-shaped composite fiber satisfies the following equation.

$$0.13 < \frac{\text{core sectional area ratio (\%)}}{100 \times \text{slit spacing } (d)} < 0.33$$

The slit spacing (d) is a distance (μm) between both ends of the open slit, and specifically means a spacing corresponding to D in FIG. 1D. The C-shaped composite fiber of the present invention satisfies the above condition between the core sectional area ratio (%) and the slit spacing (d), in which as the core sectional area ratio (%) increases, the slit spacing (d) also increases to satisfy the above condition.

Satisfying the above condition, when the C-shaped hollow fiber is manufactured using the polyester-based C-shaped composite fiber according to the present invention, the elution time of the core part may be uniform regardless of the content of the core part, so that even when the core sectional area ratio (%) is large, the core part may be eluted fast and more easily as in a small core sectional area ratio (%).

If the above condition (3) is not satisfied, it may be difficult to realize desired physical properties of the present invention, for example, the production time in the elution process may be disadvantageously lengthened, the core part residue may remain in the hollow of the C-shaped hollow fiber manufactured using the composite fiber, thereby resulting in dyeing defects caused by non-uniform elution and thus degrading quality of the hollow fiber, and hollow reduction caused by the non-eluted core part residue may result in deterioration in functions of the hollow fiber. Furthermore, in order to entirely elute the core part residue, the elution time should be extended, thereby causing alkaline attack on the sheath part of the C-shaped composite fiber and thus resulting in critical quality degradation, so that it may be difficult to realize desired physical properties of the present invention.

Next, as the condition (4), the C-shaped composite fiber satisfies the following equation.

$$1 \leq \text{Eccentric distance}(s) \times \frac{R_2}{R_1} < 2.4$$

The eccentric distance is a distance (μm) between the center of the entire cross section of the C-shaped composite fiber and the center of the core part, $R_1$ is a diameter (μm) of the entire cross section of the C-shaped composite fiber, and $R_2$ is a diameter (μm) of the cross section of the core part of the C-shaped composite fiber.

If the above condition (4) is not satisfied, that is when the position of the core part in a C-shaped composite fiber having the same core sectional area ratio (%) moves toward the center of the cross section of the C-shaped composite fiber instead of the slit of the sheath part (i.e., when the eccentric distance becomes small), it may be difficult to realize desired physical properties of the present invention, for example, the elution rate of the core part may be decreased and/or the elution time may be extended, thereby resulting in extension of manufacturing process time and quality degradation caused by the alkaline attack on the sheath part.

Specifically, it can be seen that when the above condition (4) is not satisfied (Table 7, Comparative Example 9), significantly large amount of elution time is required compared with the case where the condition (4) is satisfied. In this case, alkaline attack on the synthetic resin included in the sheath part may occur, thereby causing quality degradation of the hollow fiber manufactured after the elution.

The C-shaped composite fiber according to the present invention should satisfy all of the above conditions (1) to (4). If any one condition is not satisfied, it is difficult to realize desired physical properties of the present invention, such as the elution property, shortened elution time, prevention of alkaline attack on the sheath part through the shortened elution time, minimization of dyeing defects through smooth elution, and keeping lightness and warmth functions through minimization of elution defects.

Specifically, when any one condition of the above conditions (1) to (4) is not satisfied, desired physical properties of the present invention may not be realized, for example, the elution property may be deteriorated, thereby resulting in lengthened production time, alkaline attack on the sheath part, dyeing defects caused by non-uniform elution, and degradation of warmth and lightness caused by hollow reduction in the manufacturing process of a hollow fiber using the C-shaped composite fiber.

Meanwhile, the composite fiber of the present invention may further satisfy the following condition as the condition (5).

$$2.5 < \frac{\sqrt[4]{\text{EXP}(\text{eccentric distance } (s) \times \text{slit spacing } (d)}}{\cos\left(\frac{\text{slit angle } (\theta)}{2}\right)} < 7.5$$

When the condition (5) is satisfied in addition to the aforesaid conditions (1) to (4), the uniform elution time may be obtained regardless of the core sectional area ratio (%) of the core part in the process of eluting the core part of the composite fiber, thereby shortening the elution time compared with the case where the aforesaid conditions (1) to (4) are satisfied. Therefore, it is more advantageous in terms of the shortening of the production time, prevention of quality degradation through minimization of alkaline attack on the sheath part, and realization of desired physical properties of the present invention.

Specifically, it can be seen that elution times in Examples 3 and 7 in Table 4 below, which satisfy the condition (5) of the present invention, are less than elution times in Examples 9 and 10 in Table 5 below, which do not satisfy the condition (5) of the present invention. Accordingly, it can be seen that when the condition (5) is satisfied, the elution time is shortened compared with the case where the condition (5) is not satisfied, thereby realizing desired physical properties of the present invention.

The sheath part may include at least any one fiber-forming component of polyester or polyamide, and the core part may preferably include a polyester-based eluting component including a copolymer which is prepared by polycondensation of polyalkylene glycol and an esterification reactant including an acid component including a terephthalic acid (TPA), a diol component including ethylene glycol (EG), and a dimethyl sulfoisophthalate sodium salt (DMSIP).

The polyester-based fiber-forming component of the sheath part may be, but is not limited to, any one selected from the group consisting of polyethylene terephthalate (PET), polytrimethylene terephthalate (PTT), and polybutylene terephthalate (PBT), and the polyamide-based fiber-forming component of the sheath part may be, but is not limited to, any one selected from the group consisting of nylon 6, nylon 66, nylon 6.10, and aramid.

It may be preferable that the polyester-based eluting component of the core part is prepared by the steps including 1-1) preparing an esterification reactant which includes an acid component including a terephthalic acid and a diol component including ethylene glycol in a molar ratio of about 1:1.1 to about 1:2.0, and includes about 0.1 to about 3.0 mol % of a dimethyl sulfoisophthalate sodium salt based on the total moles of the acid component including the terephthalic acid and the dimethyl sulfoisophthalate sodium salt, and 1-2) preparing a copolymer through polycondensation after mixing about 7 to about 14 parts by weight of polyalkylene glycol with respect to 100 parts by weight of the esterification reactant. The manufacturing method and the critical significance of each component will be later described in detail in the manufacturing method of the composite fiber according to the present invention.

The C-shaped composite fiber may be a composite fiber selected from the group consisting of partially oriented yarn (POY), spin draw yarn (SDY), draw textured yarn (DTY), air textured yarn (ATY), edge crimped yarn, and interlaced yarn (ITY). Spin draw yarn (SDY), draw textured yarn (DTY), and interlaced yarn (ITY) may be preferable. When the C-shaped composite fiber is partially oriented yarn (POY) or spin draw yarn (SDY), the C-shaped composite fiber may have fineness of about 50 to about 200 denier and filament of about 18 to about 100, for ease of use and ease of process. Alternatively, when the C-shaped composite fiber is draw textured yarn, the C-shaped composite fiber may have fineness of about 30 to about 1,000 denier and filament of about 18 to about 720, for ease of use and ease of process. However, the present invention is not limited thereto. Various types of textured yarn may be used depending on the type and purpose of yarn to be manufactured, and the fineness and filament number of the textured yarn may vary depending on the purpose and application thereof.

The above described C-shaped composite fiber according to the first embodiment of the present invention may be manufactured by the following method. However, the present invention is not limited to the following manufacturing method.

Specifically, the C-shaped composite fiber may be manufactured by the steps including (1) preparing a sheath part including at least any one fiber-forming component of polyester or polyamide, and a core part including a polyester-based eluting component including a copolymer which is prepared by polycondensation of polyalkylene glycol and an esterification reactant including an acid component including a terephthalic acid (TPA), a diol component including ethylene glycol (EG), and a dimethyl sulfoisophthalate sodium salt (DMSIP), and (2) performing composite spinning to expose the core part to the outside at one side of the sheath part.

First, as step (1), the sheath part and the core part are prepared.

The fiber-forming component included in the sheath part is described. In the present invention, the sheath part may include, but is not limited to, at least any one fiber-forming component of polyester-based fiber-forming component or polyamide-based fiber-forming component.

Specifically, any material which is typically used for the C-shaped composite fiber may be used as the polyester-based fiber-forming component of the sheath part without any limitation. However, the polyester-based fiber-forming component may be any one selected from the group consisting of polyethylene terephthalate (PET), polytrimethylene terephthalate (PTT), and polybutylene terephthalate (PBT), and more preferably, may be polyethylene terephthalate (PET). However, the polyester-based fiber-forming component is not limited to the aforesaid types, but a functionality-added polyester-based fiber-forming component may be also used.

Next, any material which is typically used for the C-shaped composite fiber may be used as the polyamide-based fiber-forming component of the sheath part without any limitation. However, the polyamide-based fiber-forming component may be any one selected from the group consisting of nylon 6, nylon 66, nylon 6.10, and aramid, and more preferably, may be nylon 6. However, the polyamide-based fiber-forming component is not limited to the aforesaid types, but a functionality-added polyamide-based fiber-forming component may be also used.

Next, the eluting component included in the core part is described.

A polyester-based eluting component including a copolymer which is prepared by polycondensation of polyalkylene glycol and an esterification reactant including an acid component including a terephthalic acid (TPA), a diol component including ethylene glycol (EG), and a dimethyl sulfoisophthalate sodium salt (DMSIP), may be used for the core part. Preferably, the eluting component may be the copolymer which is prepared by polycondensation of polyalkylene glycol and the esterification reactant including the acid component including the terephthalic acid (TPA), the diol component including ethylene glycol (EG), and the dimethyl sulfoisophthalate sodium salt (DMSIP). When the polyester-based eluting component including the copolymer is used, it is advantageously possible to prevent deterioration of spinning operability caused by frequent broken yarn and an increase in packing pressure in the composite spinning process, and to prevent deterioration of dyeing uniformity caused by non-uniform weight reduction of the core part in the process of eluting the core part of the manufactured composite fiber, compared with the case where other types of copolymers are used.

The polyester-based eluting component of the core part, including a copolymer which is prepared by polycondensation of polyalkylene glycol and an esterification reactant including an acid component including a terephthalic acid (TPA), a diol component including ethylene glycol (EG), and a dimethyl sulfoisophthalate sodium salt (DMSIP), may be prepared by the following manufacturing method. However, the following manufacturing method is an exemplary embodiment, and the present invention is not limited thereto.

First, as step 1-1), the manufacturing method may include preparing an esterification reactant which includes an acid component including a terephthalic acid and a diol component including ethylene glycol in a molar ratio of about 1:1.1 to about 1:2.0, and includes about 0.1 to about 3.0 mol % of a dimethyl sulfoisophthalate sodium salt based on the total moles of the acid component including the terephthalic acid and the dimethyl sulfoisophthalate sodium salt.

The eluting component included in the core part of the present invention may include, as a monomer, an acid component including a terephthalic acid (TPA), a diol component including ethylene glycol (EG), and a dimethyl sulfoisophthalate sodium salt.

First, the acid component including the terephthalic acid of the monomer is described.

It is preferable that the present invention necessarily includes the terephthalic acid (TPA) as an acid component. However, in addition to the terephthalic acid, any acid component, which is used for a composite fiber including typical alkali-extractable polyester, may be further included without any limitation. More preferably, the acid component may include 50 mol % or more of the terephthalic acid (TPA).

Specifically, the acid component may include $C_6$-$C_{14}$ aromatic polybasic carboxylic acid in addition to the terephthalic acid, and as a non-limiting example, a dimethylterephthalic acid, an isophthalic acid, or the like may be included alone or in combination. However, the dimethylterephthalic acid has a weak esterification reactivity, thus requires additional catalysts, and its raw material cost is about 20% higher than that of the terephthalic acid, and the isophthalic acid may cause a decrease in the heat resistance of manufactured copolyester. Therefore, when other aromatic polybasic carboxylic acids are included, it is preferable that appropriate amounts thereof are mixed within a range in which desired physical properties of the present invention are not be deteriorated.

Alternatively, the acid component may include $C_2$-$C_{14}$ aliphatic polybasic carboxylic acid, and as a non-limiting example, at least any one selected from the group consisting of an oxalic acid, a malonic acid, a succinic acid, a glutaric acid, an adipic acid, a suberic acid, a citiric acid, a pimaric acid, an azelaic acid, a sebacic acid, a nonanoic acid, a decanoic acid, a dodecanoic acid, and a hexanodecanoic acid may be included. However, when the aliphatic polybasic carboxylic acid is included, the heat resistance of manufactured copolyester may decrease. Therefore, when other aliphatic polybasic carboxylic acids are included, it is preferable that appropriate amounts thereof are mixed within a range in which desired physical properties of the present invention are not be deteriorated.

Alternatively, the acid component may include at least any one component selected from the group consisting of a dicarboxylic acid and an aliphatic polybasic carboxylic acids including a heterocycle, and as a non-limiting example, at least any one selected from the group consisting of a 2,5-furandicarboxylic acid, a 2,5-thiophendicarboxylic acid, and a 2,5-pyrroledicarboxylic acid may be included.

Next, the diol component including ethylene glycol as another monomer is described.

The present invention necessarily includes the ethylene glycol (EG) as a diol component, and the diol component includes the ethylene glycol (EG). In addition to the ethylene glycol, any diol component, which is used for a composite fiber including typical alkali-extractable polyester, may be included without any limitation. Preferably, the diol component may include 50 mol % or more of the ethylene glycol (EG).

Specifically, the diol component may include $C_2$-$C_{14}$ aliphatic diol component in addition to the ethylene glycol. Specifically, the $C_2$-$C_{14}$ aliphatic diol component may be at least any one selected from the group consisting of diethylene glycol, neopentyl glycol, 1,3-propanediol, 1,4-butanediol, 1,6-hexandiol, propylene glycol, trimethyl glycol, tetramethylene glycol, pentamethyl glycol, hexamethyl glycol, heptamethylene glycol, octamethylene glycol, nonamethylene glycol, decamethylene glycol, undecamethylene glycol, dodecamethylene glycol, and tridecamethylene glycol. Preferably, the $C_2$-$C_{14}$ aliphatic diol component may be at least any one of diethylene glycol, neopentyl glycol, 1,3-propanediol, 1,4-butanediol, or 1,6-hexandiol. However, the diethylene glycol may cause broken yarn and an increase in packing pressure in the spinning process, and result in non-uniform dyeing defects caused by non-uniform weight reduction in the composite fiber and the dyeing process, so that when the diethylene glycol is further included, it is preferable that appropriate amounts thereof are mixed within a range in which desired physical properties of the present invention are not be deteriorated.

Next, the dimethyl sulfoisophthalate sodium salt as another monomer is described.

The present invention necessarily includes the dimethyl sulfoisophthalate sodium salt as a sulfonate metal salt, and the dimethyl sulfoisophthalate sodium salt has an advantage in that adsorption of water molecules may be induced thereby and the alkali-eluting property may thus be improved.

If sulfonate metal salts other than the dimethyl sulfoisophthalate sodium salt are used, it is difficult to realize desired physical properties of the present invention, for example, the alkali-eluting property is not significantly improved.

The aforesaid monomers, i.e., the terephthalic acid, the ethylene glycol, and the dimethyl sulfoisophthalate sodium salt form an esterification reactant through the esterification reaction.

According to an exemplary embodiment of the present invention, as step 1-1), the esterification reactant may include an acid component including a terephthalic acid and ethylene glycol in a molar ratio of about 1:1.1 to about 1:2.0, and may include about 0.1 to about 3.0 mol % of a dimethyl sulfoisophthalate sodium salt based on the total moles of the acid component including the terephthalic acid and the dimethyl sulfoisophthalate sodium salt.

First, the above reactant includes the terephthalic acid and the ethylene glycol in a molar ratio of about 1:1.1 to about 1:2.0, thereby having advantages in that high mechanical strength and dimensional stability may be maintained upon spinning for the manufacturing of the composite fiber. When the ethylene glycol is included with greater than 2.0 molar ratio with respect to the terephthalic acid, it may be difficult to realize desired physical properties of the present invention, for example, side reactions may be accelerated due to high acidity, thereby resulting in large amounts of diethylene glycol as a by-product. On the other hand, when the ethylene glycol is included with less than 1.1 molar ratio, it may be difficult to realize desired physical properties of the present invention, for example, degree of polymerization may be reduced due to reduced reactivity, and the eluting component having desired high molecular weight may thus not be obtained from the core part.

Next, about 0.1 to about 3.0 mol % of a dimethyl sulfoisophthalate sodium salt may be included based on the total moles of the acid component including the terephthalic acid and the dimethyl sulfoisophthalate sodium salt. When the dimethyl sulfoisophthalate sodium salt is included with less than 0.1 mol % based on the total moles of the acid component including the terephthalic acid and the dimethyl sulfoisophthalate sodium salt, it may be difficult to realize desired physical properties of the present invention, for example, the alkali-eluting property may be deteriorated, thereby increasing the alkali weight reduction process time and thus causing alkaline attack on fiber-forming polymers, and the elution may not be uniformly performed, thereby increasing fraction defective due to non-uniform dyeing in the fiber dyeing process.

On the other hand, when the dimethyl sulfoisophthalate sodium salt is included with greater than 3.0 mol % based on the total moles of the acid component including the terephthalic acid and the dimethyl sulfoisophthalate sodium salt, it is difficult to realize desired physical properties of the present invention, for example, large amounts of diethylene glycol (DEG) as a by-product may be produced due to reduced reaction stability, thereby resulting in deterioration of spinning operability caused by frequent broken yarn and an increase in packing pressure in the spinning process, and the alkali-eluting property may be too high to obtain uniform elution, thereby causing non-uniform dyeing and/or a decrease in mechanical strength of textured fibers.

In order to prepare the esterification reactant, the terephthalic acid, the ethylene glycol, and sodium 3,5-dicarbomethoxybenzene sulfonate may be mixed at any time without any limitation, for example, they may be added during the esterification reaction of the terephthalic acid and the ethylene glycol, or added from the start of the reaction.

According to an exemplary embodiment of the present invention, the esterification reactant of step 1-1) may be prepared in the presence of a metal acetate catalyst. Metal acetate including any one metal selected from the group consisting of lithium, manganese, cobalt, sodium, magnesium, zinc, and calcium, may be used for the metal acetate catalyst, alone or in combination.

Preferably, about 0.5 to about 20 parts by weight of the metal acetate catalyst may be added with respect to 100 parts by weight the sodium 3,5-decarbomethoxybenzene sulfonate. When the metal acetate catalyst is included with less than 0.5 part by weight, the esterification reaction rate may decrease and the reaction time may thus be lengthened. On the other hand, when the metal acetate catalyst is included with greater than 20 parts by weight, it may be difficult to control the sodium 3,5-dicarbomethoxybenzene sulfonate reaction and thus the content of diethylene glycol as a by-product.

The esterification reactant of step 1-1) may be preferably prepared under the condition of about 200 to about 270° C. and about 1,100 to about 1,350 Torr. When the above condition is not satisfied, the esterification reaction time may be longer, or large amounts of diethylene glycol as a by-product may be produced due to a high temperature, and the esterification reactant suitable for polycondensation cannot be formed due to reduced reactivity.

Next, the preparing method of a copolymer through polycondensation of the aforesaid esterification reactant and polyalkylene glycol According to an exemplary embodiment of the present invention, as step 1-2), about 7 to about 14 parts by weight of polyalkylene glycol may be included with respect to 100 parts by weight of the aforesaid esterification reactant.

First, the polyalkylene glycol is described.

The polyalkylene glycol may preferably be polyethylene glycol, and may have a weight-average molecular weight of about 1,000 to about 10,000. When the weight-average molecular weight is less than 1,000, the alkali-eluting property may be deteriorated, thereby increasing the alkali weight reduction process time and thus causing alkaline attack on fiber-forming components, and the elution may not be uniformly performed, thereby increasing fraction defective due to non-uniform dyeing in the fiber dyeing process. On the other hand, when the weight-average molecular weight is greater than 10,000, polymerization reactivity is reduced, the glass transition temperature of the formed copolymer may significantly decrease to deteriorate thermal properties, and spinning may not be easy to perform.

According to an exemplary embodiment of the present invention, about 7 to about 14 parts by weight of polyethylene glycol may be polycondensed with respect to 100 parts by weight of the aforesaid esterification reactant. When the polyethylene glycol is included with less than 7 parts by weight, the alkali-eluting property may be deteriorated. On the other hand, when the polyethylene glycol is included with greater than 14 parts by weight, it is difficult to realize desired physical properties of the present invention, for example, degree of polymerization may be reduced, the glass transition temperature of the copolymer may significantly decrease to deteriorate thermal properties, and the alkali-eluting property may be too high to obtain uniform elution, thereby causing non-uniform dyeing and/or a decrease in mechanical strength of textured fibers.

The polyethylene glycol may be added at any time without any limitation, for example, it may be added in the esterification reaction step of the esterification reactant, or mixed to the reactant after the esterification reaction is completed.

The copolymer of step 1-2) may be preferably prepared under the condition of about 250 to about 300° C. and about 0.3 to about 1.0 Torr. When the above condition is not satisfied, reaction time delay, reduction in degree of polymerization, pyrolysis, and the like may occur.

During the polycondensation of steps 1-2), a catalyst may be further included. As the catalyst, antimony compounds may be used to ensure adequate reactivity and reduce production costs, and phosphorous compounds may be used to inhibit discoloration at a high temperature.

The antimony compound may be antimony oxide such as antimony trioxide, antimony tetroxide, and antimony pentoxide, antimony halide such as antimony trisulfide, antimony trifluoride, and antimony trichloride, antimony triacetate, antimony benzoate, antimony tristearate, or the like.

It is preferable that about 100 to about 600 ppm of the antimony compound is used as the catalyst, based on the total weight a polymer obtained after polymerization.

It is preferable that phosphoric acids such as a phosphoric acid, monomethyl phosphate, trimethyl phosphate, and tributyl phosphate, and derivatives thereof are used as the phosphorous compounds. Among these, trimethyl phosphate, triethyl phosphate, or a triphenyl phosphorous acid is particularly preferable because the effect thereof is excellent. It is preferable that about 100 to about 500 ppm of the phosphorous compound is used, based on the total weight a polymer obtained after polymerization.

The polyester-based eluting component included in the core part, which is prepared by the aforementioned manufacturing method, may have an intrinsic viscosity of preferably about 0.6 to about 1.0 dl/g, and more preferably about 0.850 to about 1.000 dl/g, and may include about 3.6 wt % or less of diethylene glycol as a by-product.

When the intrinsic viscosity is less than 0.6 dl/g, the mechanical strength of composite fibers in spinning process may decrease, thereby deteriorating spinnability due to frequent broken yarn, and the elution property may be excessive, so that uniform elution may be difficult to perform or alkaline attack on fiber-forming polymers may be caused thereby. On the other hand, when the intrinsic viscosity is greater than 1.00 dl/g, spinning operability may be good due to high mechanical strength, but alkali-eluting property is significantly deteriorated, thereby causing an increase in the time required for the weight reduction process and non-uniform elution.

The diethylene glycol included in the polyester-based eluting component is a by-product which is additionally produced in the reaction of the terephthalic acid and ethylene glycol, and there have been many attempts to reduce the diethylene glycol as a by-product. According to the present invention, the content of diethylene glycol is preferably about 3.6 wt %, and more preferably about 3.3 wt % or less, so that the present invention may advantageously prevent difficulty in controlling of the weight reduction rate in alkaline solutions according to the by-product and defects in the dyeing process according to deterioration of spinning operability and non-uniform elution.

The eluting component of the core part according to an exemplary embodiment of the present invention has stable reactivity and an excellent reaction rate, though the cheap terephthalic acid is mainly used in the polymerization process and the dimethyl sulfoisophthalate sodium salt (DMSIP) is also used, which makes the process simple and economical without the use of esterified sulfoisophthalate glycol ester (SIGE), thereby minimizing the formation of diethylene glycol (DEG) as a by-product and the formation of foreign substances caused by ionic functional groups of the dimethyl sulfoisophthalate sodium salt (DMSIP). Therefore, it is possible to perform stable spinning without broken yarn and an increase in packing pressure in composite spinning, and perform uniform elution in eluting in an alkaline solution, so that C-shaped hollow fibers after the elution process and final products using the C-shaped hollow fibers may have uniform and dense fiber structures, thereby giving uniform dyeability and excellent soft touch. Furthermore, the composite fiber according to an exemplary embodiment of the present invention has improved strength compared with composite fibers including other typical extractable polymers, thereby advantageously minimizing deformation of the hollow in the composite fiber process such as post-treatment, for example false twist texturing, and weaving.

Next, as step (2), performing composite spinning to expose the core part to the outside at one side of the sheath part is included.

In the step (2), the weight ratio of the sheath part to the core part may be about 70:30 to about 35:65. When the content of the polyester-based fiber-forming component or the polyamide-based fiber-forming component included in the sheath part is greater than 65 wt %, strength after the elution of the composite fiber decreases, and fabrics may thus be easily torn due to low tearing strength. On the other hand, when the content is less than 30 wt %, the core sectional area ratio may be small, thereby deteriorating effects such as lightness and warmth of hollow fibers subsequently manufactured from the composite.

In the step (2), the ratio of the entire sectional area of the C-shaped composite fiber (A) to the sectional area of the core part (B) may satisfy the following equation 1.

$$\frac{A}{B} \times 100 = \text{wt \% of the core part included in the composite fiber}$$

Using the equation, the present invention may control wt % of the core part, so that the core sectional area (i.e., the hollow of subsequent hollow fibers) may be controlled and increased, and the hollow diameter of the C-shaped hollow fiber after the elution of the core part in subsequent composite fibers may be controlled and increased according to the purpose in the above step.

When the sheath part includes the polyester-based fiber-forming component, the polyester-based fiber-forming component is melted at about 275 to about 305° C. to perform composite spinning. When the sheath part includes the polyamid-based fiber-forming component, the polyamid-based fiber-forming component is melted at about 235 to about 275° C. to perform composite spinning.

The polyester-based eluting component included in the core part, which includes the copolymer prepared by polycondensation of polyalkylene glycol and the esterification reactant including the acid component including the terephthalic acid (TPA), the diol component including ethylene glycol (EG), and the dimethyl sulfoisophthalate sodium salt (DMSIP), may be melted at about 255 to about 290° C. to perform composite spinning.

The fiber solidified into fibrous tissue through the composite spinning, as it is, has undesirable molecular orientation in the fiber, so that it may be preferable that the composite-spun C-shaped composite fiber is drawn or partially oriented.

Specifically, the C-shaped composite fiber may be spun into spin draw yarn (SDY) in such a way that the C-shaped composite fiber is drawn with a first winding having a yarn speed of about 1,100 to about 1,700 mpm (m/min) and a second winding having a yarn speed about 4,000 to about 4,600 mpm (m/min), when the sheath part of the C-shaped composite fiber is the polyester-based fiber-forming component. Also, when the sheath part of the C-shaped composite fiber is the polyamid-based fiber-forming component, the C-shaped composite fiber may be drawn with a first winding having a yarn speed of about 1,000 to about 1,400 mpm (m/min) and a second winding having a yarn speed about 3,800 to about 4,400 mpm (m/min).

The C-shaped composite fiber may be spun into partially oriented yarn (POY) in such a way that the C-shaped composite fiber is partially oriented with a first winding having a yarn speed of about 2,500 to about 3,300 mpm (m/min) and a second winding having a yarn speed about 2,500 to about 3,400 mpm (m/min), when the sheath part of the C-shaped composite fiber is the polyester-based fiber-forming component. Also, when the sheath part of the C-shaped composite fiber is the polyamid-based fiber-forming component, the C-shaped composite fiber may be partially oriented with a first winding having a yarn speed of about 2,300 to about 2,800 mpm (m/min) and a second winding having a yarn speed about 2,300 to about 2,900 mpm (m/min).

Preferably, during the spinning into the spin draw yarn (SDY) and the partially oriented yarn (POY), a Godet roller (G/R) may be used in the winding to spin the C-shaped composite fiber. When the first and second windings are performed using the Godet roller in the step of manufacturing the spin draw yarn (SDY), it is preferable that the windings are performed after holding the surface temperature of the Godet roller at about 70 to about 90° C. in the first winding, and at about 100 to about 140° C. in the second winding. In such a way, broken yarn which may be caused during the drawing may be prevented.

The spin draw yarn or the partially oriented yarn spun as described above may be manufactured to preferably have fineness of about 50 to about 200 denier and filament of about 18 to about 100 for ease of use and ease of process.

FIG. 2 is a schematic sectional view of a C-shaped composite fiber according to an exemplary embodiment of the present invention, and FIG. 3 is a schematic sectional view of a C-shaped hollow fiber manufactured using the C-shaped composite fiber. The C-shaped composite fiber manufactured through the step (2) is composite-spun in the form as shown in FIG. 2, the C-shaped composite fiber including the sheath part 100 including a polyester-based fiber-forming component or a polyamide-based fiber-forming component, and the core part 200 including a polyester-based eluting component including a copolymer which is prepared by polycondensation of polyalkylene glycol and an esterification reactant including an acid component including a terephthalic acid (TPA), a diol component including ethylene glycol (EG), and a dimethyl sulfoisophthalate sodium salt (DMSIP), wherein the sheath part 100 has a C-shaped cross section to surround the core part 200, and the core part 200 is exposed to the outside at one side of the sheath part 100.

In this case, the core part 200 is exposed to the outside at one side of the sheath part 100, so that the core part may be easily eluted in the following step of eluting the core part. When the core part is eluted to the outside, a C-shaped hollow fiber may be manufactured as in FIG. 3.

Preferably, the core part 200 may be biased toward one discontinuous side in the C-shaped cross section of the sheath part 100, so that the core part may be more easily eluted. However, a C-shaped spinneret disclosed in Korean Patent Application No. 2012-0142203 filed by the present inventor may be used in order to prevent swelling of the fiber-forming component included in the sheath part, which may be caused when the composite spinning is performed in such a way that the core part is biased toward one side of the sheath part.

Next, according to an exemplary embodiment of the present invention, texturing the above manufactured C-shaped composite fiber may be further included after the step (2).

Any texturing suitable to be used in typical manufacturing process of the C-shaped composite fiber or hollow fiber may be used as the above texturing without any limitation.

It is preferable that the texturing is performed by any one method selected from the group consisting of a draw textured yarn (DTY) method, an air-jet method, and a knife-edge method. The texturing is to improve elasticity and increase air content, thereby remedying shortcomings of filament yarn.

Specifically, the C-shaped composite fiber may be post-treated into draw textured yarn (DTY) in such a way that the C-shaped composite fiber is spun into spin draw yarn (SDY) or partially oriented yarn (POY) as described above, and then is subjected to heat setting under the conditions of a yarn speed of about 400 to about 600 m/min, a twist number of about 3,000 to about 3,600 TM (twist/m), and a temperature of about 150 to about 180° C. In this case, the spin draw yarn or the partially oriented yarn may be plied to 1 to 10 plies according to applications of processed textile, and then subjected to false twist texturing to manufacture final draw textured yarn (DTY) having fineness of about 30 to about 1,000 denier for ease of use and ease of process.

The aforementioned specific false twisting texturing is merely a post-treatment method of an exemplary embodiment according to the present invention. The aforementioned post-treatment method is not limited to the above description, but various types of yarn may be manufactured by a variety of types of texturing.

Next, according to a second embodiment of the present invention, a C-shaped hollow fiber is provided, the C-shaped hollow fiber having a C-shaped cross section including an open slit, and satisfying all of the conditions (1) to (4) below.

$$30 \leq \text{hollowness } (\%) \leq 65 \quad (1)$$

$$20^\circ \leq \text{slit angle } (\theta) \leq 30^\circ \quad (2)$$

$$0.13 < \frac{\text{core sectional area ratio } (\%)}{100 \times \text{slit spacing } (d)} < 0.33 \quad (3)$$

$$1 \leq \text{Eccentric distance } (s) \times \frac{R_2}{R_1} < 2.4 \quad (4)$$

where, the slit angle (θ) is an angle between two straight lines each connecting the center of the hollow and two discontinuous points of the sheath part, the slit spacing (d) is a distance (μm) between two discontinuous points of the sheath part, the eccentric distance (s) is a distance (μm) between the center of the cross section of the C-shaped hollow fiber and the center of the cross section of the hollow, $R_1$ is a diameter (μm) of the entire cross section of the C-shaped hollow fiber, and $R_2$ is a diameter (μm) of the cross section of the hollow of the C-shaped hollow fiber.

First, as the condition (1), the C-shaped composite fiber satisfies 30≤hollowness (%)≤65.

When the hollowness is less than 30%, warmth and lightness of the hollow fiber are too low to demonstrate functions as the hollow fiber. On the other hand, when the hollowness is greater than 65%, it may be difficult to realize desired physical properties of the present invention, for example, the strength of the hollow fiber decreases due to a thin structure of the sheath part, so that the tearing strength of a fabric woven using the hollow fiber is lowered and a final product may thus be easily torn.

Specifically, when the hollowness (%) is 70% (Table 7, Comparative Example 6), the strength is 3.68 g/de, and it can thus be seen that the strength is lowered by about 11.4% compared with the case where the hollowness is 60% (Table 4, Example 4).

Next, as the condition (2), the C-shaped hollow fiber satisfies 20°≤slit angle (θ)≤30°. Specifically, FIG. 1 illustrates sectional views according to hollowness of the C-shaped hollow fiber according to an exemplary embodiment of the present invention. As shown in FIG. 1D, it can be seen that the slit angle (θ in FIG. 1D) is constant regardless of hollowness of the hollow fiber.

In the present invention, the slit angle (θ) is constant regardless of hollowness (%) because, in the C-shaped hollow fiber according to the present invention, when the hollowness (%) is small, the center of the hollow cross section in the entire cross section of the hollow fiber is biased toward the open slit of the C-shaped hollow fiber, but as the hollowness (%) increases, the center of the hollow cross section in the entire cross section of the hollow fiber moves toward the center of the entire cross section of the C-shaped hollow fiber.

When the slit angle (θ) is less than 20°, the elution time of the core part becomes longer in the manufacturing process of the C-shaped hollow fiber according to an exemplary embodiment of the present invention, so that the elution process may be lengthened. The lengthened elution process may cause alkaline attack on the sheath part of the C-shaped hollow fiber, so that it may be difficult to realize desired physical properties of the present invention, for example, quality of the C-shaped hollow fiber may be critically degraded. Also, when the hollowness (%) significantly increases, the elution time of the core part may further increases. Furthermore, remaining core parts may exist, which are not eluted in the process of eluting the core part, so that the hollow may be reduced and effects such as lightness and warmth of the hollow fiber may be deteriorated. Still furthermore, it may be difficult to realize desired physical properties of the present invention, for example, dyeing defects may occur due to non-uniform elution, thereby degrading quality of the C-shaped hollow fiber.

Specifically, it can be seen that the elution time in the case where the slit angle is 17° (Table 7, Comparative Example 7) is longer than that in the case where the slit angle is 25° (Table 4, Example 3).

When the slit angle (θ) is greater than 30°, circular structures may disappear, and air space may thus not be effectively given to the hollow, thereby causing degradation of warmth and strength. Furthermore, when the slit angle varies according to the hollowness (%), it may be difficult to realize desired physical properties of the present invention, for example, workability in post-treatment processes may be deteriorated due to different elution conditions.

Next, as the condition (3), the C-shaped hollow fiber satisfies the following equation.

$$0.13 < \frac{\text{core sectional area ratio (\%)}}{100 \times \text{slit spacing } (d)} < 0.33$$

The slit spacing (d) is a distance (μm) between both ends of the open slit, and specifically means a spacing corresponding to D in FIG. 1D. The C-shaped hollow fiber of the present invention satisfies the above condition between the hollowness (%) and the slit spacing (d), in which as the hollowness (%) increases, the slit spacing (d) also increases to satisfy the above condition.

Satisfying the above condition, when the C-shaped hollow fiber is manufactured, the elution time of the core part in the elution process of the composite fiber may be uniform regardless of hollowness, so that even when the hollowness (%) is large, the core part may be eluted fast and more easily as in small hollowness (%). Therefore, the C-shaped hollow fiber of the present invention may minimize alkaline attack.

If the above condition (3) is not satisfied, it may be difficult to realize desired physical properties of the present invention, for example, the production time in the elution process may be disadvantageously lengthened, the core part residue may remain in the hollow of the C-shaped hollow fiber, thereby resulting in dyeing defects caused by non-uniform elution and thus degrading quality of the hollow fiber, and hollow reduction caused by the non-eluted core part residue may result in deterioration in functions of the hollow fiber. Furthermore, the C-shaped hollow fiber may be attacked by alkaline solutions due to extension of the elution time, thereby resulting in quality degradation, so that it may be difficult to realize desired physical properties of the present invention.

Next, as the condition (4), the C-shaped hollow fiber satisfies the following equation.

$$1 \leq \text{Eccentric distance } (s) \times \frac{R_2}{R_1} < 2.4$$

The eccentric distance (s) is a distance (μm) between the center of the cross section of the C-shaped hollow fiber and the center of the hollow cross section, $R_1$ is a diameter (μm) of the entire cross section of the C-shaped hollow fiber, and $R_2$ is a diameter (μm) of the hollow cross section of the C-shaped hollow fiber.

If the above condition (4) is not satisfied, that is when the position of the hollow in a C-shaped hollow fiber having the same hollowness (%) moves toward the center of the cross section of the C-shaped hollow fiber instead of the open slit of the sheath part (i.e., when the eccentric distance becomes small), it may be difficult to realize desired physical properties of the present invention, for example, the elution rate of the core part may be decreased and/or the elution time may be extended, thereby resulting in extension of manufacturing process time, dyeing defects caused by non-uniform elution, and quality degradation caused by the alkaline attack on the C-shaped hollow fiber.

Specifically, it can be seen that when the above condition (4) is not satisfied (Table 7, Comparative Example 9), significantly large amount of elution time is required compared with the case where the condition (4) is satisfied. In this case, it can be seen that alkaline attack on the C-shaped hollow fiber occurs, thereby causing quality degradation of the hollow fiber manufactured after the elution, and desired physical properties of the present invention are not realized.

The C-shaped hollow fiber according to the present invention should satisfy all of the above conditions (1) to (4). If any one condition is not satisfied, it is difficult to realize desired physical properties of the present invention, that is, it is difficult to minimize dyeing defects, minimize elution defects, and demonstrate and maximize lightness and warmth functions as a hollow fiber, without destruction and deformation of the hollow.

Specifically, when any one condition of the above conditions (1) to (4) is not satisfied, the strength of the C-shaped hollow fiber may decrease, the hollow may not be entirely conserved, the production time of the hollow fiber may be lengthened due to a decrease in the elution rate of the core part, quality degradation may be caused by alkaline attack on the C-shaped hollow fiber according to an increase in the elution time, dyeing defects may be caused by non-uniform elution, and warmth and lightness may be deteriorated due to hollow reduction.

Meanwhile, the hollow fiber according to an exemplary embodiment of the present invention may further satisfy the following condition as the condition (5).

$$2.5 < \frac{\sqrt[4]{\text{EXP(eccentric distance } (s) \times \text{slit spacing } (d)}}{\cos\left(\frac{\text{slit angle } (\theta)}{2}\right)} < 7.5$$

When the condition (5) is satisfied in addition to the aforesaid conditions (1) to (4), the uniform elution time may be obtained regardless of hollowness (%) in the process of eluting the core part of the hollow fiber, thereby shortening the elution time compared with the case where the aforesaid conditions (1) to (4) are satisfied. Therefore, the C-shaped hollow fiber having excellent quality may be provided, realizing desired physical properties of the present invention, for example, minimizing alkaline attack on the C-shaped hollow fiber through reduction in production time of the hollow fiber.

Specifically, it can be seen that elution times in Examples 3 and 7 in Table 4 below, which satisfy the condition (5) of the present invention, are less than elution times in Examples 9 and 10 in Table 5 below, which do not satisfy the condition (5) of the present invention. Accordingly, it can be seen that when the condition (5) is satisfied, the elution time may be shortened compared with the case where the condition (5) is not satisfied, so that the C-shaped hollow fiber having excellent quality may be provided while alkaline attack being minimized.

The C-shaped hollow fiber may include at least any one synthetic resin of polyester or polyamide, and a detailed description thereof is as described in the C-shaped composite fiber.

The C-shaped hollow fiber may be a hollow fiber selected from the group consisting of partially oriented yarn (POY), spin draw yarn (SDY), draw textured yarn (DTY), air textured yarn (ATY), edge crimped yarn, and interlaced yarn (ITY). Spin draw yarn (SDY), draw textured yarn (DTY), and interlaced yarn (ITY) may be preferable.

The aforesaid post-treated hollow fiber may advantageously provide a C-shaped hollow fiber having improved effects such as improved elasticity and increased air content.

When the C-shaped hollow fiber is partially oriented yarn (POY) or spin draw yarn (SDY), the C-shaped hollow fiber may have fineness of about 50 to about 200 denier and filament of about 18 to about 100, for ease of use and ease of process.

Alternatively, when the C-shaped hollow fiber is draw textured yarn, the C-shaped hollow fiber may have fineness of about 30 to about 1,000 denier and filament of about 18 to about 720, for ease of use and ease of process.

However, the present invention is not limited thereto. Various types of textured yarn may be used depending on the type and purpose of yarn to be manufactured, and the fineness and filament number of the textured yarn may vary.

Specifically, FIGS. 4 to 7 is sectional views of the C-shaped hollow fiber according to an exemplary embodiment of the present invention, which is treated with false twist texturing. As shown in FIGS. 4 to 7, it can be seen that the hollow in the C-shaped hollow fiber is not collapsed at all even after false twist texturing.

The aforementioned C-shaped hollow fiber according to the second embodiment of the present invention may be manufactured by the following manufacturing method, but the present invention is not limited thereto.

The C-shaped hollow fiber may be manufactured by a method including eluting the core part from the C-shaped composite fiber of the first embodiment according to the present invention.

In the case of typical composite fibers, broken yarn, deformation, and the like have frequently occurred due to low strength of the composite fiber in the post-treatment process depending on the manufacturing process of the composite fiber and/or the type and purpose of yarn to be manufactured. Furthermore, in the case of fabrics using typical hollow fibers, the hollow has low strength, so that the hollow fiber prepared by eluting the composite fiber could not be itself woven or knitted to manufacture fabrics. Therefore, fabrics was typically woven of knitted using the composite fiber, and then was subjected to the weight reduction process for eluting the core part of the composite fiber.

However, the fabric, of which the core part was eluted by the typical method as described above, had significantly low strength, so that tearing of the fabric could not be prevented.

On the contrary, the C-shaped composite fiber and the C-shaped hollow fiber according to the present invention may have improved strength compared with typical C-shaped composite fibers and/or C-shaped hollow fibers, so that even if the fabric is manufactured using the C-shaped hollow fiber obtained by eluting the core part from the C-shaped composite fiber, the fabric has significantly excellent mechanical properties, thereby preventing the fabric from tearing.

Specifically, the C-shaped composite fiber included in an exemplary embodiment of the present invention has improved strength compared with typical composite fibers (see Table 4), so that destruction or deformation of the core part of the composite fiber in the manufacturing process including post-treatment may be minimized compared with typical composite fibers, and the fabric may be manufactured by weaving or knitting in a hollow fiber state.

The elution of the core part may be performed using an alkaline solution, and examples of the specific method for eluting may include methods known in the art. However, the core part may be eluted by a method including 1-1) plying the C-shaped composite fibers to 1 to 10 plies in a dyeing paper tube to perform soft winding, and 1-2) treating the C-shaped composite fibers wound in the dyeing paper tube with an about 1 to about 5 wt % of a sodium hydroxide solution at about 80 to about 100° C. to elute the core parts.

The composite fibers are plied to 1 to 10 plies in the step 1-1) and the core part may be eluted through the step 1-2). Using these steps, the composite fiber is controlled to various fineness and filament numbers demanded by consumers, thereby requiring no additional plying process in the subsequent process, so that it is advantageously possible to reduce the production time, simplify the manufacturing process, and respond the needs of customers without an additional process.

In the step 1-2), the solution for eluting the core part may be preferably about 1 to about 5% of a sodium hydroxide solution. When the concentration of the sodium hydroxide (NaOH) solution is less than 1%, the elution takes a long time. On the other hand, when the concentration of the sodium hydroxide (NaOH) solution is greater than 5%, at least any one fiber-forming component of the polyester-based fiber-forming component of the polyamide-based fiber-forming component included in the sheath part is attacked by the alkaline solution, defects may be caused in the C-shaped hollow fiber, thereby decreasing strength and deteriorating operability in the process such as weaving and knitting.

In the step 1-2), the elution time in the sodium hydroxide (NaOH) solution may vary depending on the concentration of the sodium hydroxide solution, but may be preferably about 10 to about 120 minutes. Preferably, the elution temperature may be about 80 to 100° C. for atmospheric pressure, and about 60 to about 120° C. for high pressure. If the elution temperature according to the pressure does not fall within the above range, the hollow ratio may decrease due to non-uniform elution, and quality of the fabric may be deteriorated due to non-uniform dyeing.

Meanwhile, a third embodiment according to the present invention includes a fabric including the C-shaped hollow fiber of the second embodiment according to the present invention.

The fabric may be a woven fabric or a knitted fabric manufactured by weaving or knitting.

First, the weave structure of the woven fabric may be subject to any one method selected from the group consisting of plain weave, twill weave, satin weave, and double weave.

When the plain weave, twill weave, and satin weave are referred to as three basic types of weave, the specific weaving method of each of the three basic types of weave is subject to a typical weaving method. On the basis of the three basic types of weave, the structure may be modified or a few structures may be mixed to obtain fancy weave. Examples of fancy plain weave include rib weave and basket weave, examples of fancy twill weave include elongated twill weave, broken twill weave, skip twill weave, and pointed twill weave, and examples of fancy satin weave include irregular satin weave, double satin weave, satin check weave, and granite satin weave.

The double weave is a fabric-weaving method in which either warp or weft is doubled or both of them are double, and the specific method thereof may be a typical weaving method of the double weave.

However, the present invention is not limited to the aforesaid weave structure, and density of warp and weft in weaving is not particularly limited.

Preferably, the knitting may be subject to weft knitting or warp knitting, and the specific method of the weft knitting and the warp knitting may be subject to typical weft knitting and warp knitting.

Using the weft knitting, weft knit such as plain knit, rib knit, and purl knit may be manufacture, and using the warp knitting, warp knit such as tricot, Milanese, and raschel may be manufactured.

Furthermore, the fabric may be manufactured by mixed weaving or mixed knitting of the C-shaped hollow fiber according to the present invention and a different type of grey yarn. A fabric according to an exemplary embodiment of the present invention may be mixed-woven or mixed-knitted with a different type of grey yarn for the purpose of the fabric to be manufactured and for the grant of new functions.

Specifically, FIGS. 4 to 7 is sectional views of the C-shaped hollow fiber according to an exemplary embodiment of the present invention, which is treated with false twist texturing. As shown in FIGS. 4 to 7, it can be seen that the hollow in the C-shaped hollow fiber is not collapsed at all even after false twist texturing. Also, the hollow in the fabric woven using the C-shaped hollow fiber is not collapsed at all, and it can thus be seen that warmth and lightness of the fabric are excellent.

The aforementioned fabric including the C-shaped hollow fiber according to the third embodiment of the present invention may be manufactured by the following manufacturing method, but the present invention is not limited thereto.

First, step (1) of preparing the C-shaped composite fiber according to the first embodiment of the present invention is performed, and then step (2) of eluting the core part from the composite fiber is performed.

The step (1) is the same as the detailed description in the first embodiment of the present invention and the manufacturing thereof, and the description thereof will thus be omitted. Likewise, the step (2) is the same as the detailed description in the second embodiment of the present invention and the manufacturing thereof, and the description thereof will thus be omitted.

For the hollow fiber prepared through the step (2), step (3) of weaving or knitting including the core-eluted hollow fiber to manufacture the fabric is performed.

The specific description about the weaving and knitting is as described above, and will thus be omitted.

The manufacturing method of the aforementioned fabric including the C-shaped hollow fiber is different in steps of performing the alkali weight reduction process from manufacturing methods of fabrics including typical hollow fibers. That is, typically, fabrics were manufactured using composite fibers, and weight reduction was then performed in a fabric state. In the case of these typical manufacturing methods, during the manufacturing of fabrics after hollow yarn is prepared by performing weight reduction in a grey yarn state, mechanical strength such as strength and elongation of the hollow yarn is too low to withstand weaving or knitting, thereby significantly deteriorating the productivity of fabrics. However, in the present invention, even if the C-shaped hollow fiber is manufactured after the elution of the C-shaped composite fiber, mechanical strength such as strength and elongation of the fabric is significantly excellent, thereby being capable of withstanding weaving or knitting, so that grey yarn is not broken in the manufacturing process of the fabric and the productivity of the fabric is thus not deteriorated.

Furthermore, the C-shaped hollow fiber having these features according to the present invention may be particularly useful in manufacturing the fabric mixed-woven or mixed-knitted with a different type of grey yarn. Specifically, when a fiber easily attacked by alkaline solutions is included as the different type of grey yarn, the different type of grey yarn may be critically damaged in the weight reduction process because the weight reduction process is typically performed in a fabric state. However, in the case of the hollow fiber according to the present invention, the fabric is manufactured by mixed weaving or mixed knitting with a different type of fiber in a weight-reduced state. Accordingly, the different type of fiber may be prevented from being damaged by alkali, and manufactured fabric may thus have excellent quality.

Meanwhile, a fourth embodiment according to the present invention includes a fabric including the aforementioned C-shaped composite fiber of the first embodiment according to the present invention, and the fabric may be realized using a manufacturing method of the fabric including the C-shaped composite fiber, the method including (1) preparing the C-shaped composite fiber according to the first embodiment, and (2) weaving or knitting including the composite fiber to manufacture the fabric The fabric may include only the C-shaped composite fiber according to the present invention, or may be mixed-woven or mixed-knitted with a different type of fiber. A detailed description about the fourth embodiment is as described above, and will be omitted.

Hereinafter, the present invention will be described in more detail through Examples. Example below are intended to facilitate understanding of the present invention, but the scope of the present invention should not be limited thereto.

Example 1

First, as a polyester-based fiber-forming component to be included in the sheath part, polyethylene terephthalate was melted at 290° C. in order to prepare the sheath part. In order to prepare the core part, a compound of a terephthalic acid (TPA) and ethylene glycol (EG) was adjusted to a molar ratio of 1:1.2, and a dimethyl sulfoisophthalate sodium salt was adjusted to 1.5 mol % based on the total moles of the terephthalic acid (TPA) and the dimethyl sulfoisophthalate sodium salt (DMSIP). 10.0 parts by weight of lithium acetate was mixed as a catalyst to perform the esterification reaction at 250° C. and 1,140 Torr, based on 100 parts by weight of the dimethyl sulfoisophthalate sodium salt (DMSIP), and an ester reactant was obtained with 97.5% degree of reaction. The formed ester reactant was transferred to a polycondensation reactor, and 10.0 parts by weight of polyethylene glycol (PEG) having a molecular weight of 6,000 was added thereto, based on 100 parts by weight of the esterification reactant, and then 400 ppm of antimony trioxide as a polycondensation catalyst was added thereto, thereafter while reducing pressure to a final pressure of 0.5 Torr, temperature was raised to 285° C. to prepare a copolymer through polycondensation.

The eluting component, that is the copolymer which was prepared by polycondensation of polyethylene glycol and the esterification reactant including the terephthalic aid (TPA), the ethylene glycol (EG), and the dimethyl sulfoisophthalate sodium salt (DMSIP), was melted to 270° C., thereafter the melted polyethylene terephthalate and the copolymer was composite-spun at a weight ratio of 70:30 to prepare a drawn composite fiber (SDY) having a filament number of 36 and fineness of 75 denier according to Table 4 under the condition of Table 1 below. G/R in Table 1 below means the Godet roller.

Subsequently, the prepared spin draw yarn was soft-wound in a dyeing paper tube, and then elution was performed in a grey yarn state in 4 wt % of a sodium hydroxide solution at 95° C. and atmospheric pressure to prepare a C-shaped hollow fiber.

Using a Rapier weaving machine (Picanol GTM Co.), the prepared C-shaped hollow fiber was woven into a plain weave fabric having warp density of 156/inch and weft density of 102/inch. The woven plain weave fabric was subjected to scouring (CPB scouring) and subsequent washing (B/O) as a typical method, and preset under the condition of 40 m/min at 200, thereafter subjected to dyeing (RAPID, 125° C.×60 min) and texturing (190° C.×40 m/min) to manufacture a fabric.

TABLE 1

| Yarn type | Spinning temperature (° C.) | G/R1 speed (mpm, m/min) | G/R1 temperature (° C.) | G/R2 speed (mpm, m/min) | G/R2 temperature (° C.) |
|---|---|---|---|---|---|
| Spin draw yarn (SDY) | 285 | 1,500 | 90 | 4,400 | 125 |

Examples 2 to 4

A drawn composite fiber (SDY), a hollow fiber (SDY) and a fabric as shown in Table 4 below were manufactured by the same method as in Example 1, except that composite spinning was performed at the weight ratio of 60:40, 50:50, and 40:60 (sheath part:core part).

Examples 5 to 8

A drawn composite fiber (SDY), a hollow fiber (SDY) and a fabric as shown in Table 4 below were manufactured by the same method as in Examples 1 to 4, except that the filament number was 36 and fineness was 100 denier.

Example 9

A C-shaped composite fiber, a hollow fiber, and a fabric according to Table 5 were manufactured by the same method as in Example 3, except that the eccentric distance of the conditions in Table 4 was 1.5 μm instead of 2.14 μm.

Example 10

A C-shaped composite fiber, a hollow fiber, and a fabric according to Table 5 were manufactured by the same method as in Example 7, except that the eccentric distance of the conditions in Table 4 was 1.5 μm instead of 2.47 μm.

Examples 11 to 15

A C-shaped composite fiber, a hollow fiber, and a fabric were manufactured by the same method as in Example 4, except that the composite-spun composite fiber was manufactured as a partially oriented composite fiber (POY) having fineness of 123 denier and filament of 36 according to Table 5 under the condition in Table 2 below, instead of the spin draw yarn (SDY).

TABLE 2

| Yarn type | Spinning temperature (° C.) | G/R1 speed (mpm, m/min) | G/R1 temperature (° C.) | G/R2 speed (mpm, m/min) | G/R2 temperature (° C.) |
|---|---|---|---|---|---|
| Partially oriented yarn (POY) | 285 | 2,930 | — | 3,030 | — |

Subsequently, manufactured partially oriented yarn (POY) was plied to 1 ply, 2 plies, 4 plies, 6 plies, and 8 plies, and then was manufactured to false twist textured composite fiber (DTY) according to Table 5, under the conditions of yarn speed of 500 m/min, a twist number of Z-twist of 3,300 to 3,500 TM (twist/m), and heat setting of 160 to 165° C. Thereafter, the manufactured false twist textured composite fiber was subjected to soft winding in a dyeing paper tube, then elution was performed in a grey yarn state in 4 wt % of a sodium hydroxide solution to manufacture a false twist textured hollow fiber (DTY), and a fabric was manufactured using the hollow fiber.

Example 16

A nylon drawn composite fiber, a hollow fiber (SDY), and a fabric were manufactured by the same method as in Example 3, except that instead of the polyethylene terephthalate, nylon 6 was melted at 250° C. in the sheath part to manufacture the nylon drawn composite fiber having fineness of 75 denier and filament of 36 according to Table 6 under the condition in Table 3 below.

TABLE 3

| Yarn type | Spinning temperature (° C.) | G/R1 speed (mpm, m/min) | G/R1 temperature (° C.) | G/R2 speed (mpm, m/min) | G/R2 temperature (° C.) |
|---|---|---|---|---|---|
| Spin draw yarn (SDY) | 275 | 1,200 | 80 | 4,000 | 120 |

Comparative Examples 1 to 4

A C-shaped composite fiber, a hollow fiber, and a fabric were manufactured by the same method as in Examples 1 to 4, except that instead of the polyester-based eluting component including a copolymer prepared by polycondensation of polyalkylene glycol and an esterification reactant including an acid component including a terephthalic acid (TPA), a diol component including ethylene glycol (EG), and a dimethyl sulfoisophthalate sodium salt (DMSIP), Bellpure (KB SEIREN Co.) was melted at 275° C. in the core part to manufacture the C-shaped composite fiber through composite spinning.

Comparative Examples 5 and 6

A composite fiber, a hollow fiber and a fabric according to the conditions in Table 7 were manufactured by the same method as in Example 1, except that the weight ratio of the sheath part to the core part was 73:27 and 30:70 instead of 70:30.

Comparative Examples 7 and 8

A composite fiber, a hollow fiber and a fabric according to the conditions in Table 7 were manufactured by the same method as in Example 3, except that the slit angle was 17° and 37°.

Comparative Example 9

A composite fiber, a hollow fiber and a fabric according to the conditions in Table 7 were manufactured by the same method as in Example 3, except that the eccentric distance (s) was 1.3 μm.

Experimental Example 1

Physical properties below were measured for C-shaped composite fibers, C-shaped hollow fibers, and fabrics in Examples 1 to 8, Examples 11 to 15, and Comparative Examples 1 to 4, in which specimens were prepared to satisfy the conditions (1) to (5) below, Examples 9 and 10 in which specimens were prepared to satisfy the conditions (1) to (4) below, Comparative Examples 5 to 9 in which specimens were prepared not to satisfy any one of the conditions (1) to (4) below, and the results were shown in Tables 4 to 7.

1. Whether the Conditions are Satisfied $$30 \leq \text{hollowness (\%)(or core sectional area ratio (\%)} \leq 65 \quad (1)$$

$$20^\circ \leq \text{slit angle } (\theta) \leq 30^\circ \quad (2)$$

$$0.13 < \frac{\text{hollowness (\%)}}{100 \times \text{slit spacing } (d)} < 0.33 \text{ or } \left(0.13 < \frac{\text{core sectional area ratio (\%)}}{100 \times \text{slit spacing } (d)} < 0.33\right) \quad (3)$$

$$1 \leq \text{Eccentric distance } (s) \times \frac{R_2}{R_1} < 2.4 \quad (4)$$

$$2.5 < \frac{\sqrt[4]{\text{EXP(eccentric distance } (s) \times \text{slit spacing } (d)}}{\cos\left(\frac{\text{slit angle } (\theta)}{2}\right)} < 7.5 \quad (5)$$

2. Strength and Elongation

The strength and the elongation of composite fibers and hollow fibers in the present invention were measured using an automatic tensile tester (Textecho Co.) in which speed of 50 cm/min and grip distance of 50 cm were applied. The strength was defined as a value (g/de) obtained by dividing a load by denier, the load being applied to a fiber when the fiber is elongated until the fiber is broken under a constant force, and the elongation was defined as percentage (%) of the elongated length with respect to an initial length Specifically, as shown in Tables 4 to 7 below, it can be seen that in Examples 1 to 4 in which the core part includes a copolymer according to an exemplary embodiment of the present invention, which is prepared by polycondensation of polyalkylene glycol and an esterification reactant reacted including the terephthalic acid, the ethylene glycol, and the dimethyl sulfoisophthalate sodium salt, the strength and elongation of the C-shaped composite fiber and the C-shaped hollow fiber after the elution of the core part are significantly excellent compared with Comparative Examples 1 to 4 in which Bellpure (KB SEIREN Co.) is included in the core part. Accordingly, it can be seen that in Comparative Examples 1 to 4, the number of stops of the weaving machine also increases due to broken yarn during the weaving process according to a decrease in mechanical strength compared with Examples 1 to 4.

3. Core Elution Time

In other to evaluate the elution time of the core part in the present invention, the C-shaped composite fiber was subjected to elution in 2 wt % of a sodium hydroxide solution at 100° C. and atmospheric pressure, and the time required to entirely elute the core part compared with the weight of the core part included in the C-shaped composite fiber was measured.

Specifically, as shown in Tables 4 to 7 below, it can be seen through Examples 1 to 8 that the elution time is constant in the same fineness regardless of the core sectional area ratio (%).

It can be seen that the elution time in Examples 3 and 7, in which specimens satisfy the condition (5) of the present invention, is less than that in Examples 9 and 10 in which specimens do not satisfy the condition (5) of the present invention. Accordingly, it can be seen that when the condition (5) is satisfied, the elution time may be shortened compared with the case where the condition (5) is not satisfied.

4. Core Elution Property (%)

In order to evaluate the elution property of the core part in the present invention, the C-shaped composite fiber was subjected to elution for 18 minutes in 2 wt % of a sodium hydroxide solution at 100° C. and atmospheric pressure, and then the weights of the composite fiber before and after elution were measured to calculate the elution property (%). In the C-shaped hollow fibers having the same hollowness, as the elution property increases, lightness and warmth is further improved and quality degradation such as dyeing defects is less likely to occur.

Specifically, as shown in Tables 4 to 7 below, it can be seen that in Examples 1 to 4, when the elution was performed for 18 minute under the above condition, the elution property was 100% meaning that the core part was entirely eluted. Connecting these results to the above elution time measurement, in the case of the present invention, even if the core sectional area ratio (%) increases, the elution time required to entirely elute the core part is almost the same as the case where the core sectional area ratio (%) is small, thereby being capable of minimizing alkaline attack on the components included in the sheath part of the composite fiber according to the present invention. Furthermore, due to the entire elution, the C-shaped hollow fiber manufactured after the elution has excellent lightness and warmth, and do not cause dyeing defects, so that quality degradation did not occur.

5. Spinnability

The spinnability in the present invention was evaluated as the yield of the composite fiber with no broken yarn, when 9 kg drum of C-shaped composite fiber (spin draw yarn or partially oriented yarn) was spun in full winding. ◎ mark means that the yield is 100 to 95%, O mark means that the yield is 95 to 90%, and X mark means that the yield is less than 90%.

Specifically, as shown in Tables 4 to 7 below, it can be seen that broken yarn during spinning is more common in Comparative Examples than in Examples, and particularly, the spinnability is not good in Comparative Example 6 in which the hollowness (%) does not satisfy the condition (1) of the present invention, Comparative Example 7 in which the slit angle does not satisfy the condition (2) of the present invention, and Comparative Example 9 in which specimens do not satisfy the condition (4) of the present invention.

6. Warmth

In evaluating the warmth in the present invention, a test fabric specimen of 50 cm×50 cm was prepared to measure the thermal insulation ratio on the basis of KS K 0560 and KS K 0466 methods.

Specifically, as shown in Tables 4 to 7 below, it can be seen that as the hollowness increases, the warmth increases (see Examples 1 to 4), and in spite of the same hollowness, the warmth increases when weaving is performed with grey yarn of a lot of plies (see Examples 11 to 15).

In the case of Comparative Examples 6, 7, and 9, the spinnability was not good, and filament yarn could not be prepared enough to manufacture a fabric, so that the warmth could not be measured.

7. Weavability (Count)

The Weavability was evaluated by the number of stops of the weaving machine caused by broken yarn during the weaving of a fabric of 1.76 m×91.4 m.

As shown in Tables 4 to 7 below, it can be seen that the weavability is significantly affected by the strength of the hollow fiber. Comparing under the same hollowness, it can be seen that the weaving in Examples (see Examples 1 to 4), in which specimens have excellent strength, is better than that in Comparative Examples see Comparative Examples 1 to 4).

In the case of Comparative Examples 6, 7, and 9, the spinnability was not good, and filament yarn could not be prepared enough to manufacture a fabric, so that the weavability could not be measured.

8. Dyeing Non-Uniformity

The dyeing non-uniformity was visually evaluated in the manufactured fabric of 1.76 m×91.44 m. When dyeing non-uniformity was not observed, it was evaluated as 0, and when dyeing non-uniformity was observed, it was evaluated as 1 to 5 according to the degree of non-uniformity.

As shown in Tables 4 to 7 below, it can be seen that the dyeing non-uniformity was less likely to occur as the elution property increased. However, even if the elution property was 100%, the dyeing non-uniformity was observed. It might be considered that even if it seemed to be entire elution by the calculation of the elution property, actually, some of the core part was not eluted, and the fiber-forming component of the hollow fiber was attacked by an alkaline solution as much as the weight of the non-eluted core part, so that the elution property was consequently calculated to be 100%. One of this reason is expected to be performance differences in alkali-eluting property of alkali-extractable copolyester included in the core part, which is supported through the result that the dyeing non-uniformity occurs in Comparative Examples 1 to 4 compared with Examples 1 to 4

In the case of Comparative Examples 6, 7, and 9, the spinnability was not good, and filament yarn could not be prepared enough to manufacture a fabric, so that the dyeing non-uniformity could not be measured.

TABLE 4

| | | Example 1 | Example 2 | Example 3 | Example 4 | Example 5 | Example 6 | Example 7 | Example 8 |
|---|---|---|---|---|---|---|---|---|---|
| Texturing type | | SDY | SDY | SDY | SDY | SDY | SDY | SDY | SDY |
| denier/filament | | 75/36 | 75/36 | 75/36 | 75/36 | 100/36 | 100/36 | 100/36 | 100/36 |
| Ply | | 1 | 1 | 1 | 1 | 1 | 1 | 1 | 1 |
| Core sectional area ratio (%) | | 30 | 40 | 50 | 60 | 30 | 40 | 50 | 60 |
| Slit spacing (μm) | | 1.75 | 2.02 | 2.25 | 2.47 | 2.02 | 2.33 | 2.6 | 2.85 |
| Eccentric distance (μm) | | 3.31 | 2.69 | 2.14 | 1.65 | 3.82 | 3.1 | 2.47 | 1.9 |
| C-shaped composite fiber sectional diameter (μm) | | 14.62 | 14.62 | 14.62 | 14.62 | 16.88 | 16.88 | 16.88 | 16.88 |
| Core sectional diameter (μm) | | 8.01 | 9.25 | 10.34 | 11.32 | 9.25 | 10.68 | 11.94 | 13.07 |
| Slit angle (°) | | 25 | 25 | 25 | 25 | 25 | 25 | 25 | 25 |
| Condition 1 | | ○ | ○ | ○ | ○ | ○ | ○ | ○ | ○ |
| Condition 2 | | ○ | ○ | ○ | ○ | ○ | ○ | ○ | ○ |
| Condition 3 | | 0.18 | 0.2 | 0.23 | 0.25 | 0.15 | 0.18 | 0.2 | 0.22 |
| Condition 4 | | 1.81 | 1.7 | 1.51 | 1.28 | 2.09 | 1.96 | 1.75 | 1.47 |
| Condition 5 | | 4.36 | 3.98 | 3.41 | 2.84 | 7.05 | 6.23 | 5.1 | 3.97 |
| Composite fiber | Strength (g/de') | 4.53 | 4.42 | 4.35 | 4.20 | 4.58 | 4.40 | 4.32 | 4.23 |
| | Elongation (%) | 30.21 | 29.55 | 30.46 | 29.81 | 30.13 | 31.09 | 28.98 | 28.89 |
| Hollow fiber | Fineness (de') | 52.42 | 45.38 | 36.72 | 29.84 | 68.69 | 59.45 | 49.68 | 38.76 |
| | Strength (g/de') | 4.47 | 4.45 | 4.34 | 4.15 | 4.50 | 4.37 | 4.18 | 4.21 |
| | Elongation (%) | 15.84 | 16.24 | 15.53 | 16.17 | 14.98 | 15.37 | 16.31 | 14.67 |
| Core elution time (min) | | 16.43 | 16.49 | 16.48 | 16.51 | 18.12 | 18.21 | 18.28 | 18.31 |
| Elution property (%) | | 100 | 100 | 100 | 100 | 99.8 | 99.5 | 99.3 | 99.3 |
| Spinnability | | ◎ | ◎ | ◎ | ◎ | ◎ | ◎ | ◎ | ◎ |
| Warmth | | 14 | 17 | 19 | 22 | 14 | 16 | 18 | 22 |
| Weavability | | 0 | 0 | 0 | 0 | 0 | 0 | 0 | 0 |
| Dyeing non-uniformity | | 0 | 0 | 0 | 0 | 0 | 0 | 0 | 0 |

TABLE 5

| | Example 9 | Example 10 | Example 11 | Example 12 | Example 13 | Example 14 |
|---|---|---|---|---|---|---|
| Texturing type | SDY | SDY | DTY | DTY | DTY | DTY |
| denier/filament | 75/36 | 100/36 | 75/36 | 150/72 | 300/144 | 450/216 |
| Ply | 1 | 1 | 1 | 21 | 4 | 6 |

TABLE 5-continued

| | | Example 9 | Example 10 | Example 11 | Example 12 | Example 13 | Example 14 |
|---|---|---|---|---|---|---|---|
| Core sectional area ratio (%) | | 50 | 50 | 60 | 60 | 60 | 60 |
| Slit spacing (μm) | | 2.24 | 2.18 | 2.47 | 2.47 | 2.47 | 2.47 |
| Eccentric distance (μm) | | 1.5 | 1.5 | 1.65 | 1.65 | 1.65 | 1.65 |
| C-shaped composite fiber sectional diameter (μm) | | 14.62 | 16.88 | 14.62 | 14.62 | 14.62 | 14.62 |
| Core sectional diameter (μm) | | 10.34 | 11.94 | 11.32 | 11.32 | 11.32 | 11.32 |
| Slit angle (°) | | 25 | 21 | 25 | 25 | 25 | 25 |
| Condition 1 | | ○ | ○ | ○ | ○ | ○ | ○ |
| Condition 2 | | ○ | ○ | ○ | ○ | ○ | ○ |
| Condition 3 | | 0.23 | 0.23 | 0.25 | 0.25 | 0.25 | 0.25 |
| Condition 4 | | 1.06 | 1.06 | 1.28 | 1.28 | 1.28 | 1.28 |
| Condition 5 | | 2.37 | 2.3 | 2.84 | 2.84 | 2.84 | 2.84 |
| Composite fiber | Strength (g/de') | 4.30 | 3.87 | 3.91 | 3.89 | 3.83 | 3.79 |
| | Elongation (%) | 30.16 | 28.22 | 29.89 | 30.46 | 29.18 | 27.00 |
| Hollow fiber | Fineness (de') | 37.21 | 36.55 | 58.61 | 113.52 | 175.73 | 236.91 |
| | Strength (g/de') | 4.16 | 3.79 | 4.01 | 3.94 | 3.68 | 3.87 |
| | Elongation (%) | 17.92 | 13.99 | 14.36 | 14.65 | 14.12 | 12.53 |
| Core elution time (min) | | 17.34 | 20.65 | 16.52 | 16.51 | 16.53 | 16.52 |
| Elution property (%) | | 100 | 95.1 | 100 | 100 | 100 | 100 |
| Spinnability | | ◎ | ◎ | ◎ | ◎ | ◎ | ◎ |
| Warmth | | 15 | 16 | 25 | 29 | 33 | 38 |
| Weavability | | 1 | 2 | 0 | 1 | 1 | 1 |
| Dyeing non-uniformity | | 2 | 3 | 0 | 0 | 0 | 0 |

TABLE 6

| | | Example 15 | Example 16 | Comparative Example 1 | Comparative Example 2 | Comparative Example 3 | Comparative Example 4 |
|---|---|---|---|---|---|---|---|
| Texturing type | | DTY | SDY | SDY | SDY | SDY | SDY |
| denier/filament | | 600/288 | 75/36 | 75/36 | 75/36 | 75/36 | 75/36 |
| Ply | | 8 | 1 | 1 | 1 | 1 | 1 |
| Core sectional area ratio (%) | | 60 | 50 | 30 | 40 | 50 | 60 |
| Slit spacing (μm) | | 2.47 | 2.25 | 1.75 | 2.02 | 2.25 | 2.47 |
| Eccentric distance (μm) | | 1.65 | 2.14 | 3.31 | 2.69 | 2.14 | 1.65 |
| C-shaped composite fiber sectional diameter (μm) | | 14.62 | 14.62 | 14.62 | 14.62 | 14.62 | 14.62 |
| Core sectional diameter (μm) | | 11.32 | 10.34 | 8.01 | 9.25 | 10.34 | 11.32 |
| Slit angle (°) | | 25 | 25 | 25 | 25 | 25 | 25 |
| Condition 1 | | ○ | ○ | ○ | ○ | ○ | ○ |
| Condition 2 | | ○ | ○ | ○ | ○ | ○ | ○ |
| Condition 3 | | 0.25 | 0.23 | 0.18 | 0.2 | 0.23 | 0.25 |
| Condition 4 | | 1.28 | 1.51 | 1.81 | 1.7 | 1.51 | 1.28 |
| Condition 5 | | 2.84 | 3.41 | 4.36 | 3.98 | 3.41 | 2.84 |
| Composite fiber | Strength (g/de') | 3.79 | 4.98 | 4.19 | 4.09 | 3.97 | 3.84 |
| | Elongation (%) | 27.00 | 40.23 | 28.35 | 29.82 | 30.14 | 28.41 |
| Hollow fiber | Fineness (de') | 236.91 | 36.89 | 52.31 | 43.78 | 36.72 | 29.84 |
| | Strength (g/de') | 3.87 | 4.86 | 4.09 | 4.11 | 3.99 | 3.80 |
| | Elongation (%) | 12.53 | 23.31 | 16.84 | 15.24 | 16.73 | 14.24 |
| Core elution time (min) | | 16.52 | 16.49 | 16.57 | 16.28 | 16.34 | 16.58 |
| Elution property (%) | | 100 | 100 | 100 | 100 | 100 | 100 |
| Spinnability | | ◎ | ◎ | ◎ | ◎ | ◎ | ◎ |
| Warmth | | 43 | 20 | 11 | 14 | 16 | 18 |
| Weavability | | 1 | 0 | 1 | 1 | 2 | 2 |
| Dyeing non-uniformity | | 0 | 0 | 1 | 1 | 2 | 2 |

TABLE 7

| | Comparative Example 5 | Comparative Example 6 | Comparative Example 7 | Comparative Example 8 | Comparative Example 9 |
|---|---|---|---|---|---|
| Texturing type | SDY | SDY | SDY | SDY | SDY |
| denier/filament | 75/36 | 75/36 | 75/36 | 75/36 | 75/36 |

TABLE 7-continued

| | | Comparative Example 5 | Comparative Example 6 | Comparative Example 7 | Comparative Example 8 | Comparative Example 9 |
|---|---|---|---|---|---|---|
| Ply | | 1 | 1 | 1 | 1 | 1 |
| Core sectional area ratio (%) | | 27 | 70 | 50 | 50 | 50 |
| Slit spacing (μm) | | 1.65 | 2.65 | 1.53 | 3.29 | 2.24 |
| Eccentric distance (μm) | | 3.51 | 1.19 | 2.14 | 2.14 | 1.3 |
| C-shaped composite fiber sectional diameter (μm) | | 14.62 | 14.62 | 14.62 | 14.62 | 14.62 |
| Core sectional diameter (μm) | | 7.6 | 12.24 | 10.34 | 10.34 | 10.34 |
| Slit angle (°) | | 25 | 25 | 17 | 37 | 25 |
| Condition 1 | | X | X | ○ | ○ | ○ |
| Condition 2 | | ○ | ○ | X | X | ○ |
| Condition 3 | | 0.17 | 0.27 | 0.32 | 0.16 | 0.22 |
| Condition 4 | | 1.82 | 1 | 1.51 | 1.51 | 0.92 |
| Condition 5 | | 4.36 | 2.25 | 2.29 | 6.13 | 2.12 |
| Composite fiber | Strength (g/de') | 4.51 | 3.72 | 4.32 | 2.21 | 2.45 |
| | Elongation (%) | 30.82 | 26.31 | 30.93 | 30.21 | 29.13 |
| Hollow fiber | Fineness (de') | 55.21 | 22.51 | 37.64 | 36.56 | 36.89 |
| | Strength (g/de') | 4.39 | 3.68 | 4.24 | 2.35 | 2.43 |
| | Elongation (%) | 16.03 | 13.23 | 14.34 | 15.67 | 13.11 |
| Core elution time (min) | | 18.75 | 17.36 | 27.73 | 16.43 | 24.29 |
| Elution property (%) | | 98.1 | 100 | 74.3 | 100 | 84.4 |
| Spinnability | | ○ | X | X | ○ | X |
| Warmth | | 10 | — | — | 18 | — |
| Weavability | | 1 | — | — | 2 | — |
| Dyeing non-uniformity | | 2 | — | — | 0 | — |

What is claimed is:

1. A C-shaped hollow fiber consists of one C-shaped cross section comprising a sheath part and one hollow part, and the sheath part including an open slit, wherein the C-shaped hollow fiber satisfies all of the conditions (1) to (4) below.

$$30 \leq \text{hollowness (\%)} \leq 65 \quad (1)$$

$$20° \leq \text{slit angle } (\theta) \leq 30° \quad (2)$$

$$0.13 < \frac{\text{hollowness (\%)}}{100 \times \text{slit spacing } (d)} < 0.33 \quad (3)$$

$$1 \leq \text{Eccentric distance } (s) \times \frac{R_2}{R_1} < 2.4 \quad (4)$$

where, the slit angle (θ) is an angle between two straight lines each connecting a center of a cross section of the hollow part and two discontinuous points of a sheath part, the slit spacing (d) is a distance (μm) between two discontinuous points of the sheath part, the eccentric distance (s) is a distance (μm) between a center of an entire cross section of the C-shaped hollow fiber including the hollow part and the center of the cross section of the hollow part, $R_1$ is a diameter (μm) of the entire cross section of the C-shaped hollow fiber including the hollow part, and $R_2$ is a diameter (μm) of the cross section of the hollow part of the C-shaped hollow fiber.

2. The C-shaped hollow fiber of claim 1, comprising at least any one component of polyester or polyamide.

3. The C-shaped hollow fiber of claim 1, further satisfying the condition (5) below.

$$2.5 < \frac{\sqrt[4]{\text{EXP(eccentric distance } (s) \times \text{slit spacing } (d))}}{\cos\left(\frac{\text{slit angle } (\theta)}{2}\right)} < 7.5. \quad (5)$$

4. The C-shaped hollow fiber of claim 1, wherein the C-shaped hollow fiber is any one selected from the group consisting of partially oriented yarn (POY), spin draw yarn (SDY), draw textured yarn (DTY), air textured yarn (ATY), edge crimped yarn, and interlaced yarn (ITY).

5. A fabric including a C-shaped hollow fiber, the fabric comprising the C-shaped hollow fiber of claim 1.

* * * * *